US010789806B2

(12) United States Patent
Kukita et al.

(10) Patent No.: US 10,789,806 B2
(45) Date of Patent: Sep. 29, 2020

(54) PLAYER TRACKING DEVICE, GAMING MACHINE, AND INFORMATION TERMINAL

(71) Applicant: Universal Entertainment Corporation, Tokyo (JP)

(72) Inventors: Noritoshi Kukita, Tokyo (JP); Yuya Konno, Tokyo (JP); Jun Haishima, Tokyo (JP); Shigehiko Kitagawa, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 216 days.

(21) Appl. No.: 15/506,417

(22) PCT Filed: Aug. 17, 2015

(86) PCT No.: PCT/JP2015/073039
§ 371 (c)(1),
(2) Date: Feb. 24, 2017

(87) PCT Pub. No.: WO2016/031610
PCT Pub. Date: Mar. 3, 2016

(65) Prior Publication Data

US 2018/0225920 A1 Aug. 9, 2018

(30) Foreign Application Priority Data

Aug. 28, 2014 (JP) ..... 2014-174507

(51) Int. Cl.
*G07F 17/32* (2006.01)
*G07F 17/34* (2006.01)

(52) U.S. Cl.
CPC ..... *G07F 17/3239* (2013.01); *G07F 17/3213* (2013.01); *G07F 17/34* (2013.01)

(58) Field of Classification Search
CPC .. G07F 17/3225; G07F 17/3239; G07F 17/34; G07F 17/32; G07F 17/3202
USPC ..... 463/42
See application file for complete search history.

(56) References Cited

U.S. PATENT DOCUMENTS 4,764,666 A * 8/1988 Bergeron ..... G07F 7/1008 463/25
7,627,496 B2 * 12/2009 Walker ..... G06Q 20/02 705/16
7,882,033 B2 * 2/2011 Halbritter ..... G06Q 10/10 705/50
8,842,156 B1 * 9/2014 Alekhin ..... G06Q 10/10 348/14.01
9,257,001 B2 * 2/2016 Angell ..... G07F 17/3209
(Continued)

FOREIGN PATENT DOCUMENTS

JP 2006-334152 12/2006
WO 2004/034734 4/2004

*Primary Examiner* — Chase E Leichliter
(74) *Attorney, Agent, or Firm* — Lex IP Meister, PLLC

(57) ABSTRACT

Provided is a player tracking device which is operable to separate voice of a player from surrounding sound including presentation sound outputted from speakers of gaming machines and to effectively and clearly input the voice of a player with microphones. The player tracking device has two directional microphones which are arranged so as to be spaced apart; analyzes difference between sounds from relative positions of said microphones and sound data inputted from said microphones; and executes sound data processing.

4 Claims, 26 Drawing Sheets

(56) References Cited

U.S. PATENT DOCUMENTS

| | | | | |
|---|---|---|---|---|
| 2004/0162144 | A1* | 8/2004 | Loose | G07F 17/32 463/42 |
| 2005/0059494 | A1* | 3/2005 | Kammler | G07F 17/32 463/42 |
| 2005/0213432 | A1* | 9/2005 | Hoshuyama | H04M 1/03 367/129 |
| 2006/0154729 | A1* | 7/2006 | LeMay | G07F 17/32 463/42 |
| 2007/0038570 | A1* | 2/2007 | Halbritter | G06Q 10/10 705/50 |
| 2007/0184896 | A1* | 8/2007 | Dickerson | G07F 17/32 463/25 |
| 2007/0207857 | A1* | 9/2007 | Angell | G07F 17/32 463/36 |
| 2008/0202889 | A1* | 8/2008 | Breitenbach | G06Q 10/087 194/217 |
| 2008/0305875 | A1* | 12/2008 | Heim | G07F 17/3293 463/42 |
| 2009/0131146 | A1* | 5/2009 | Arezina | G07F 17/32 463/20 |
| 2009/0197684 | A1* | 8/2009 | Arezina | G07F 17/3216 463/42 |
| 2011/0034238 | A1* | 2/2011 | Phillips | G07F 17/32 463/25 |
| 2011/0045911 | A1* | 2/2011 | Parham | G07F 17/32 463/42 |

* cited by examiner

FIG.9

SYMBOL COMBINATION TABLE

| SYMBOL COMBINATION | | | | | PAYOUT NUMBER | WINNING COMBINATION |
|---|---|---|---|---|---|---|
| 1ST VIDEO REEL | 2ND VIDEO REEL | 3RD VIDEO REEL | 4TH VIDEO REEL | 5TH VIDEO REEL | | |
| **RED** | **RED** | **RED** | **RED** | **RED** | **15** | **RED** |
| APPLE | APPLE | APPLE | APPLE | APPLE | **12** | **APPLE** |
| BLUE 7 | BLUE 7 | BLUE 7 | BLUE 7 | BLUE 7 | 10 | BLUE |
| BELL | BELL | BELL | BELL | BELL | 8 | BELL |
| CHERRY | CHERRY | CHERRY | CHERRY | CHERRY | 5 | CHERRY3 |
| STRAWBERRY | STRAWBERRY | STRAWBERRY | STRAWBERRY | STRAWBERRY | 5 | STRAWBERRY |
| PLUM | PLUM | PLUM | PLUM | PLUM | 4 | PLUM |
| ORANGE | ORANGE | ORANGE | ORANGE | ORANGE | 3 | ORANGE3 |
| CHERRY | CHERRY | CHERRY | (ANY) | (ANY) | 2 | CHERRY2 |
| ORANGE | ORANGE | ORANGE | (ANY) | (ANY) | 2 | ORANGE2 |
| CHERRY | (ANY) | (ANY) | (ANY) | (ANY) | 1 | CHERRY1 |
| ORANGE | (ANY) | (ANY) | (ANY) | (ANY) | 1 | ORANGE1 |

FIG. 21A

MEMBERSHIP MANAGEMENT TABLE

| IDENTIFICATION CODE | MEMBER NAME | ICON DATA | ··· |
|---|---|---|---|
| 0001 | ○○○○ | ..\image0001.jpg | ··· |
| 0002 | △△△△ | ..\image0002.jpg | ··· |
| 0003 | ▽▽▽▽ | ..\image0003.jpg | ··· |
| 0004 | □□□□ | ..\image0004.jpg | ··· |
| 0005 | ×××× | ..\image0005.jpg | ··· |
| 0006 | ◎◎◎◎ | ..\image0006.jpg | ··· |
| 0007 | ◇◇◇◇ | ..\image0007.jpg | ··· |
| 0008 | ◿◿◿◿ | ..\image0008.jpg | ··· |
| 0009 | ☆☆☆☆ | ..\image0009.jpg | ··· |
| ··· | ··· | ··· | ··· |

FIG. 21B

FRIENDS MANAGEMENT TABLE

| IDENTIFICATION CODE | FRIENDS' IDENTIFICATION CODE | STATUS |
|---|---|---|
| 0001 | 0002 | OK |
| 0001 | 0003 | OK |
| 0001 | 0005 | BLOCK |
| 0001 | 0007 | OK |
| 0001 | 0009 | OK |
| ··· | ··· | ··· |
| 0002 | 0001 | OK |
| 0002 | 0003 | OK |
| 0002 | 0008 | OK |
| 0003 | 0001 | OK |
| 0003 | 0002 | OK |
| ··· | ··· | ··· |

FIG. 21C

ADDRESS MANAGEMENT TABLE

| IDENTIFICATION CODE | IP ADDRESS | GAMING MACHINE IDENTIFIER |
|---|---|---|
| 0001 | 192.168.52.4 | GM-1 |
| 0002 | 192.168.52.8 | GM-2 |
| 0003 | 192.168.52.13 | GM-3 |
| 0004 | 192.168.52.22 | GM-4 |
| 0005 | 192.168.52.28 | GM-8 |
| 0006 | 192.168.52.29 | GM-10 |
| 0007 | 192.168.52.48 | GM-9 |
| 0008 | 192.168.52.51 | KIOSK-1 |
| ··· | ··· | ··· |

PLAYER TRACKING DEVICE, GAMING MACHINE, AND INFORMATION TERMINAL

TECHNICAL FIELD

The present invention relates to a player tracking device which is incorporated into a gaming machine.

BACKGROUND ART

Conventionally, there has been proposed a game system which is operable to conduct a game by using an information card, instead of a paper type method, on gaming machines. Each of the gaming machines which this game system has includes: a bill validator which identifies bills whose currency kinds are different from one another and a money amount of said bill or bills and outputs data indicating a result of the identification; a player tracking device which converts the data outputted from the bill validator to credit data for executing a game based on an exchange rate internally stored and transmits the credit data to a gaming machine; a control device to which an exchange rate is inputted externally and which updates an exchange rate stored in the player tracking device by providing the inputted exchange rate for the player tracking device; and an information card device which causes the information card to store data corresponding to a money amount awarded to a player in accordance with an outcome of the game played on the gaming machine and based on the data corresponding to the money amount read out from the information card, transmits credit data for executing a game (refer to Patent Literature 1) to the gaming machine.

Here, the above-described player tracking device is mounted so as to be integrated into each of the gaming machines and is a device for realizing a player tracking system (PTS). The player tracking system is a system which causes an IC card to store an identification information unique to a player (a person who plays a game on a gaming machine) and allows a player to carry this IC card with him or her as an IC card unique to said player and to use this IC card, thereby enabling a player to be identified and managed on a terminal to which this IC card is inserted. When a player inserts the IC card (player card) into the player tracking device, information such as a balance in an account of said player is displayed on a display device or the like of the player tracking device, a game is executed on a gaming machine based on credit data managed by the IC card, and a credit obtained as an outcome of the game is added for the player identified by said IC card.

In addition, there also has been proposed a player tracking device which is configured to form a unit integrated to have a microphone function, a camera function, a speaker function, a display function, and the like (refer to Patent Literature 2). Specifically, the player tracking device has an LCD, a human body detection camera, a microphone, a bass reflex type speaker, and the like, and the microphone is used to allow a player to participate in a game by voice and to authenticate a player through voice recognition.

CITATION LIST

Patent Literature

Patent Literature 1: U. S. Patent Application Publication No. 2012/0135799

Patent Literature 2: U.S. Pat. No. 8,777,734

SUMMARY OF THE INVENTION

Technical Problem

As described above, the player tracking device disclosed in Patent Literature 2 is provided with the single microphone to which voice of a player can be inputted. In a hall, however, a lot of people come in and out, and a multitude of gaming machines are installed. Further, since these gaming machines are located so as to be adjacent to one another, noise and surrounding sound including presentation sound outputted from speakers of the gaming machines are extremely loud. Therefore, it is very difficult to separate voice of a player from the surrounding sound and to pick up only the voice of a player with said microphone.

In addition, if the voice of a player cannot be effectively and clearly inputted with the microphone, when a player makes a phone call or the like via said microphone while playing a game, the voice of a player cannot be conveyed to a called party, thereby impairing effectiveness of phone call service.

Solution to Problem

The present invention provides a player tracking device, a gaming machine and an information terminal, described below.

In view of the above-described regard, the present invention has been made. Objects of the present invention are to provide a player tracking device which is operable to separate voice of a player from surrounding sound including presentation sound outputted from speakers of gaming machines and to effectively and clearly input the voice of a player with microphones; a gaming machine; and an information terminal.

The player tracking device according to a first aspect of the present invention has the below-described configuration.

The player tracking device is integrated into a gaming machine (for example, a slot machine 1010 shown in FIG. 4) and includes a plurality of microphones (for example, microphones 1715 and 1717 shown in FIG. 8) being arranged so as to be spaced from each other at a predetermined interval, and a controller (for example, a controller 1750) of the player tracking device (for example, a PTS terminal 1700 shown in FIG. 8) executes a process described below:

a process in which from relative positional relationship of the plurality of microphones and sound data inputted from the plurality of microphones, based on difference between sounds inputted from the plurality of microphones, sound data processing is executed.

By employing the above-described configuration, the player tracking device is integrated into the gaming machine and includes the plurality of microphones arranged so as to be spaced from each other at the predetermined interval, and from the relative positional relationship of the plurality of microphones and the sound data inputted from the plurality of microphones, based on the difference between the sounds inputted from the plurality of microphones, the sound data processing is executed. Thus, the voice of a player can be separated from the surrounding sound including the presentation sound outputted from the speakers of the gaming machines, and the voice of a player can be effectively and clearly inputted with the microphones.

A gaming machine according to a second aspect of the present invention has the below-described configuration.

The gaming machine on which based on rearranged symbols (for example, symbols 1501 of pseudo reels 1151 to 1155), a payout is awarded includes:

a display device (for example, a lower image display panel 1141) for displaying a plurality of reels (for example, the pseudo reels 1151 to 1155), each of the reels having a plurality of symbols depicted on an external surface;

a cabinet (for example, a cabinet 1011) for internally housing the display device;

a controller (for example, a controller 1100) of the gaming machine for rotating and stopping the plurality of reels and controlling the symbols depicted on the plurality of reels to be rearranged; and the player tracking device according to the first aspect which is incorporated into the cabinet.

By employing the above-described configuration, the gaming machine includes the player tracking device according to the first aspect, and from the relative positional relationship of the plurality of microphones and the sound data inputted from the plurality of microphones, based on the difference between the sounds inputted from the plurality of microphones, the sound data processing is executed. Thus, the voice of a player can be separated from the surrounding sound including the presentation sound outputted from the speakers of the gaming machines, and the voice of a player can be effectively and clearly inputted with the microphones.

An information terminal according to a third aspect of the present invention has the below-described configuration.

The information terminal includes:

a display device (for example, an LCD 1719 of a PTS terminal 1700 shown in FIG. 8, an LCD 201 of a kiosk terminal 200 shown in FIG. 18, or the like) for displaying information; and an input device (for example, a touch panel of the LCD 1719 of the PTS terminal 1700 shown in FIG. 8, a touch panel of the LCD 201 of the kiosk terminal 200 shown in FIG. 18, or the like) for inputting an instruction of a user, a controller (for example, a controller 1750 of the PTS terminal 1700 shown in FIG. 8, a kiosk terminal controller 220 of the kiosk terminal 200 shown in FIG. 18, or the like) of the information terminal executing processes described below:

a process (A) in which by reading an IC card (IC card 1500) of the user being a member and a user information recording medium (the IC card 1500 or a magnetic card) of other member being different from the user (for example, by reading contents of the IC card 1500 or the like by a card unit 1741 and a touch unit 1745 of the PTS terminal shown in FIG. 8), information (for example, pieces of information such as a member name obtained by referencing tables shown in FIG. 21A and FIG. 21B) pertinent to the other member being registered as a call destination of the user is displayed on the display device; and a process (B) in which in accordance with the instruction (for example, touching a "CALL" button display part in a call destination detail display part 82*a* of a friends list display screen 91 shown in FIG. 25A) inputted by the input device of the user, a VoIP phone call is made to the other member being selected as the call destination.

By employing the above-described configuration, the information terminal includes: the display device for displaying the information; and the input device for inputting the instruction of the user, and by reading the IC card of the user being the member and the IC card of the other member being different from the user, the information pertinent to the other member being registered as the call destination of the user is displayed on the display device, and in accordance with the instruction inputted by the input device of the user, the VoIP phone call is made to the other member being selected as the call destination. Thus, by using the gaming machines and the kiosk terminal installed in a hall, IP telephones can be utilized between members.

In the third aspect, the information terminal according to a fourth aspect of the present invention further has the below-described configuration. In the process (A), only when the other member has caused the user information recording medium of the other member to be read on other information terminal (for example, when the IC card 1500 is read by the card unit 1741 of the PTS terminal 1700 shown in FIG. 8, a card unit 230 shown in FIG. 18, or the like), the information pertinent to the other member is displayed on the display device as the call destination to which the phone call is enabled.

By employing the above-described configuration, on the information terminal, further, in the process in which the information pertinent to the member is displayed on the display device, only when the other member has caused his or her own IC card or the like to be read on the other information terminal, the information pertinent to the other member is displayed on the display device as the call destination to which the phone call is enabled. Thus, a player of the gaming machine can easily find the member who is playing a game in a hall.

A gaming machine according to a fifth aspect of the present invention has the below-described configuration.

The gaming machine on which based on rearranged symbols, a payout is awarded includes:

a second display device for displaying a plurality of reels, each of the reels having a plurality of symbols depicted on an external surface;

a cabinet for internally housing the second display device;

a controller of the gaming machine for rotating and stopping the plurality of reels and controlling the symbols depicted on the plurality of reels to be rearranged; and the information terminal according to the third aspect being incorporated into the cabinet.

By employing the above-described configuration, the gaming machine includes the information terminal according to the third aspect, and by reading the IC card of the user being the member and the IC card of the other member being different from the user, the information pertinent to the other member being registered as the call destination of the user is displayed on the display device, and in accordance with the instruction inputted by the input device of the user, the VoIP phone call is made to the other member being selected as the call destination. Thus, by using gaming machines and kiosk terminals installed in a hall, IP telephones can be utilized between members.

Effects of the Invention

By employing the configuration of the game system according to the present invention, the voice of a player can be separated from the surrounding sound including the presentation sound outputted from the speakers of the gaming machines and the voice of a player can be effectively and clearly inputted with the microphones.

BRIEF DESCRIPTION OF THE DRAWINGS

FIG. 9 is a diagram showing an example of a symbol combination table which the slot machine according to the one embodiment of the present invention includes.

FIGS. 21A to 21C are diagrams showing an example of tables used in the game system according to the one embodiment of the present invention.

DESCRIPTION OF EMBODIMENTS

A first embodiment of the present invention will be described with reference to the accompanying drawings.

[Description of Outline of Game System]

Figure 1:
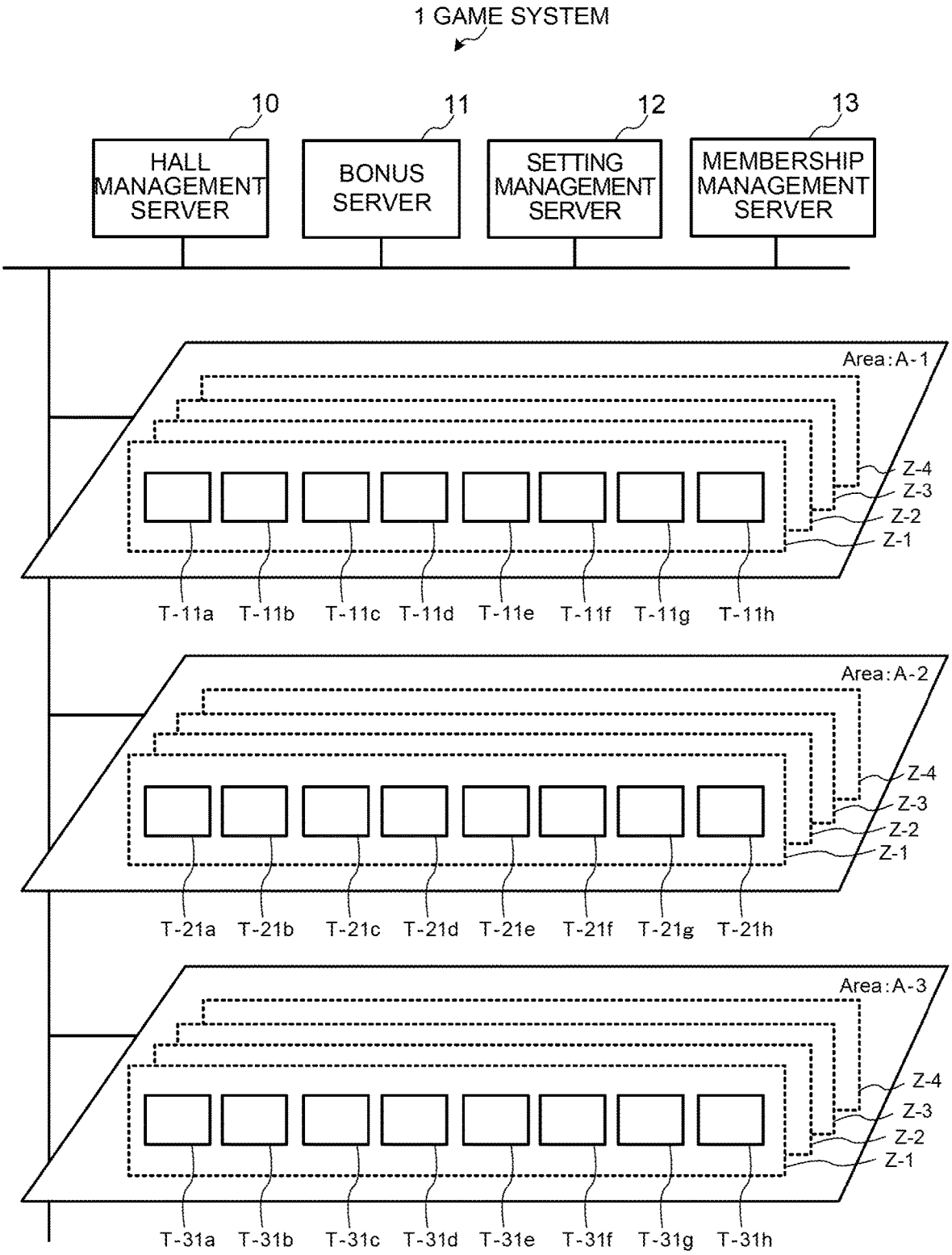
FIG. 1 is a diagram schematically illustrating a game system according to one embodiment of the present invention.

First, with reference to FIG. 1, an outline of a game system will be described. FIG. 1 is a schematic diagram schematically illustrating an overview of the game system 1 according to the first embodiment of the present invention.

The game system 1 includes: a hall management server 10, a bonus server 11, a setting management server 12, a membership management server 13, and a plurality of gaming machines.

The hall management server 10 totalizes and manages a flow of money within a hall (game facility), prepares a balance sheet and the like, and manages the other servers. In addition, the hall management server 10 obtains, from the respective gaming machines, accounting information which includes timing at which each of the gaming machines starts a unit game; timing at which each of the gaming machines terminates the unit game; a drawing result in the unit game; and the like and accumulates the accounting information.

The bonus server 11 controls a bonus drawing in a bonus game and linkage presentation conducted in association with the bonus drawing. In addition, the bonus server 11, for example, manages an accumulated value for providing a bonus (for example, credits accumulated for a progressive bonus). The setting management server 12 stores and manages setting related to gaming machines, on each of which the bonus drawing is conducted, and setting related to the linkage presentation. It is to be noted that although in the present embodiment, the description is given by taking the bonus game as an example, other kinds of games may be conducted.

The membership management server 13 is a server which stores and manages personal information of members, membership card (IC card) information, the past game outcomes of the members, and the like. Issuance of membership cards (IC cards) is made by, for example, a membership card issuing terminal. The personal information of the members, inputted upon member registration, is stored on the membership management server 13 together with identification codes of the membership cards. In addition, the membership card issuing terminal is provided with a camera which allows also shooting of a face of a player for which an IC card is issued upon issuing of a membership card. The shot image is stored on the membership management server 13 so as to be associated with an identification code.

As shown in FIG. 1, the gaming machines are installed in a plurality of areas (for example, as shown in FIG. 1, A-1 to A-3). Here, the areas correspond to, for example, one floor of a hall or areas within the floor. In this example, although the areas from A-1 to A-3 are shown, this is merely one example.

Further, the gaming machines are installed in each zone (for example, as shown in FIG. 1, in Z-1 to Z-4) within each of the areas. Here, each of the zones corresponds to specific space within each of the areas. In this example, although the four zones (Z-1 to Z-4) are provided in each of the areas, respectively, this is also merely one example. In addition, in this example, although eight gaming machines are installed in each one of the zones, respectively, this is also merely one example, and various numbers of the gaming machines can be installed.

As shown in FIG. 1, in the zone Z-1 of the area A-1, eight gaming machines of T-11a to T-11h are installed; similarly, in the zone Z-2 of the area A-1, eight gaming machines of T-12a to T-12h are installed (thereinafter, not shown); in the zone Z-3 of the area A-1, eight gaming machines of T-13a to T-13h are installed; and in the zone Z-4 of the area A-1, eight gaming machines of T-14a to T-14h are installed.

Further, as shown in FIG. 1, in the zone Z-1 of the area A-2, eight gaming machines of T-21a to T-21h are installed; similarly, in the zone Z-2 of the area A-2, eight gaming machines of T-21a to T-22h are installed (thereinafter, not shown); in the zone Z-3 of the area A-2, eight gaming machines of T-23a to T-23h are installed; and in the zone Z-4 of the area A-2, eight gaming machines of T-24a to T-24h are installed. In addition, in the zone Z-1 of the area A-3, eight gaming machines of T-31a to T-31h are installed; similarly, in the zone Z-2 of the area A-3, eight gaming machines of T-32a to T-32h are installed (thereinafter, not shown); in the zone Z-3 of the area A-3, eight gaming machines of T-33a to T-33h are installed; and in the zone Z-4 of the area A-3, eight gaming machines of T-34a to T-34h are installed.

It is to be noted that although it is schematically shown that the respective gaming machines are connected to the hall management server 10 and the bonus server 11 via a LAN connection by Ethernet (a registered trademark), the more detailed connection form will be described later.

In addition, each of the gaming machines is provided with a unique identifier, and the hall management server 10 or the like identifies transmission sources of data transmitted from the respective gaming machines by using the identifiers. In addition, also in a case where the hall management server 10 or the like transmits data to the gaming machines, based on the identifiers, transmission destinations are specified. Although as the identifiers, for example, network addresses such as IP addresses can be used, identifiers other than the network addresses may be provided, thereby allowing the individual gaming machines to be managed.

It is to be noted that the game system 1 may be constructed within one hall (game facility) where various games can be conducted or may be constructed over a plurality of game facilities. In addition, when the game system 1 is constructed in a single game facility, the game system 1 may be constructed in each floor or section of the game facility. A communication line for connecting the servers and the gaming machines may be a wired or wireless line and can adopt a dedicated line, an exchange line, or the like.

[Description of Outline of Gaming Machine]

Figure 2:
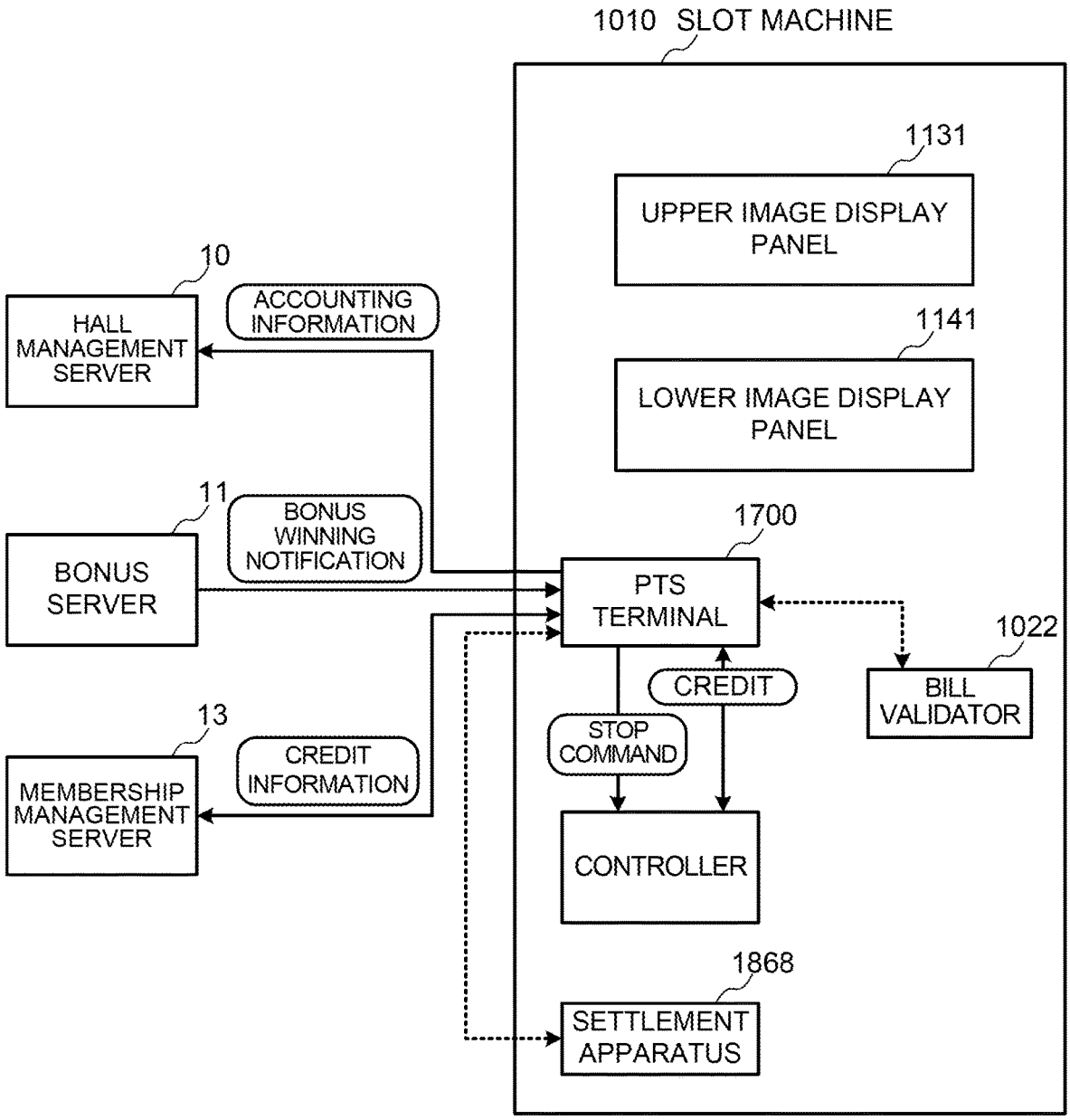
FIG. 2 is a diagram schematically illustrating a slot machine according to the one embodiment of the present invention.

Next, with reference to FIG. 2, an outline of a gaming machine according to the embodiment of the present invention will be described. In FIG. 2, a configuration of a slot machine 1010 which is a gaming machine configured integrally with a player tracking device (Player Tracking Device) is conceptually shown. It is to be noted that the player tracking device is a terminal for realizing a player tracking system (Player Tracking System) and in the present specification, hereinafter, this device is referred to as a PTS terminal. It is to be noted that although in the below description, a case where the slot machine is used as the gaming machine will be described, the present invention is not limited to the case of the slot machine and is applicable to a gaming machine which conducts a variety of games.

As shown in FIG. 2, the slot machine 1010 has the PTS terminal 1700 mounted therein and further includes a settlement apparatus 1868. The slot machine 1010 is connected via the PTS terminal 1700 to the hall management server 10, the bonus server 11, and the like via a network. In the present embodiment, one slot machine 1010 is provided with one PTS terminal 1700 mounted in one part of a housing thereof.

In the present embodiment, the PTS terminal 1700 is connected to a bill validator 1022 via a communication line (or the slot machine 1010).

In addition, based on a predetermined protocol, the PTS terminal 1700 conducts transmission and reception of data to and from a controller (the later-described controller 1100 of the slot machine 1010) and conducts data communication with the hall management server 10, the bonus server 11, and the like connected via the network. For example, from the PTS terminal 1700 to the controller, information pertinent to a credit required to start a game, a stop command to instruct to stop a unit game upon linkage presentation, and the like can be transmitted, and from the gaming controller to the PTS terminal 1700, information pertinent to a credit as a game outcome, start notification of the unit game, and termination notification thereof can be transmitted.

In addition, from the PTS terminal 1700 to the hall management server 10, the start notification and the termination notification of the unit game, accounting information including a drawing result or the like, and the like are transmitted. From the bonus server 11 to the PTS terminal 1700 (of a predetermined slot machine 1010), bonus winning notification is transmitted. Further, between the PTS terminal 1700 and the membership management server 13, information pertinent to credits of members or the like is communicated.

Here, an outline of a game flow in a case of members is as described below. First, member registration is conducted by using the membership card issuing terminal, and at this time, a membership card (IC card) is issued. Thereafter, a player inserts the membership card into the PTS terminal 1700 of the slot machine 1010 and inputs cash there. When a bill or bills have been inputted, the bill validator 1022 identifies a currency kind and a money amount and transmits currency kind data and money amount data as an identification result to the PTS terminal 1700. The PTS terminal 1700 calculates a credit for a game from the currency kind data and the money amount data and transmits the calculated credit to the controller.

Based on the credit transmitted from the PTS terminal 1700, the controller executes the game. A credit in accordance with a game outcome is transmitted from the controller to the PTS terminal 1700, calculation for paying-out based on the game outcome is performed on the PTS terminal 1700, and a money amount to be paid out to a player is determined. On the PTS terminal 1700, the determined money amount is written onto the membership card as it is, and the membership card is ejected. In addition, in accordance with the execution or the like of the game, predetermined points are provided for the membership card.

In a case where a player who is a member plays a game next, the PTS terminal 1700 reads the inserted membership card and then reads out the money amount stored in the membership card. The read-out money amount is converted to a credit and the converted credit is transmitted to the controller. A credit in accordance with a game outcome is transmitted from the controller to the PTS terminal 1700 as mentioned above, calculation for paying-out based on the game outcome is performed on the PTS terminal 1700, and a money amount to be paid out to a player is determined. At this time, the money amount obtained as the game outcome is added to the money amount of the membership card, thereby updating this.

Further, at this time, the PTS terminal 1700 transmits an identification code (or a member ID) read out from the membership card and the updated money amount to the membership management server 13, and the membership management server 13 adds the money amount transmitted from the PTS terminal 1700 to a money amount of a member identified by the above-mentioned identification code and stores said money amount. By conducting this processing, the money amount which the member holds is invariably managed.

Thereafter, if needed, a player who is a member can make settlement at a cashier counter or the like, based on the money amount stored on the membership card. In addition, as in the above-described slot machine 1010, in a case where the settlement apparatus 1868 is included therein, on said slot machine 1010, the settlement can be made by using the membership card.

On the other hand, an outline of a game flow in a case where a player is a non-member is as described below. A player inputs cash to the PTS terminal 1700 of the slot machine 1010. When the bill or bills have been inputted, the bill validator 1022 identifies a currency kind and a money amount and transmits currency kind data and money amount data as an identification result to the PTS terminal 1700. The PTS terminal 1700 calculates a credit for a game from the currency kind data and the money amount data and transmits the calculated credit to the controller.

Based on the credit transmitted from the PTS terminal 1700, the controller executes the game. A credit in accordance with a game outcome is transmitted from the controller to the PTS terminal 1700, calculation for paying-out based on the game outcome is performed on the PTS terminal 1700, and a money amount to be paid out to a player is determined. On the PTS terminal 1700, this determined money amount is written onto a new IC card stocked in the slot machine 1010, and the IC card is ejected. Here, the non-member gets the IC card for the first time.

Thereafter, if needed, a player who is the non-member can make settlement at a cashier counter or the like based on the money amount stored on the IC card. In addition, as in the above-described slot machine 1010, in a case where the settlement apparatus 1868 is included therein, on said slot machine 1010, the settlement can be made by using the IC card.

[Description of Function Flow Diagram]

Figure 3:
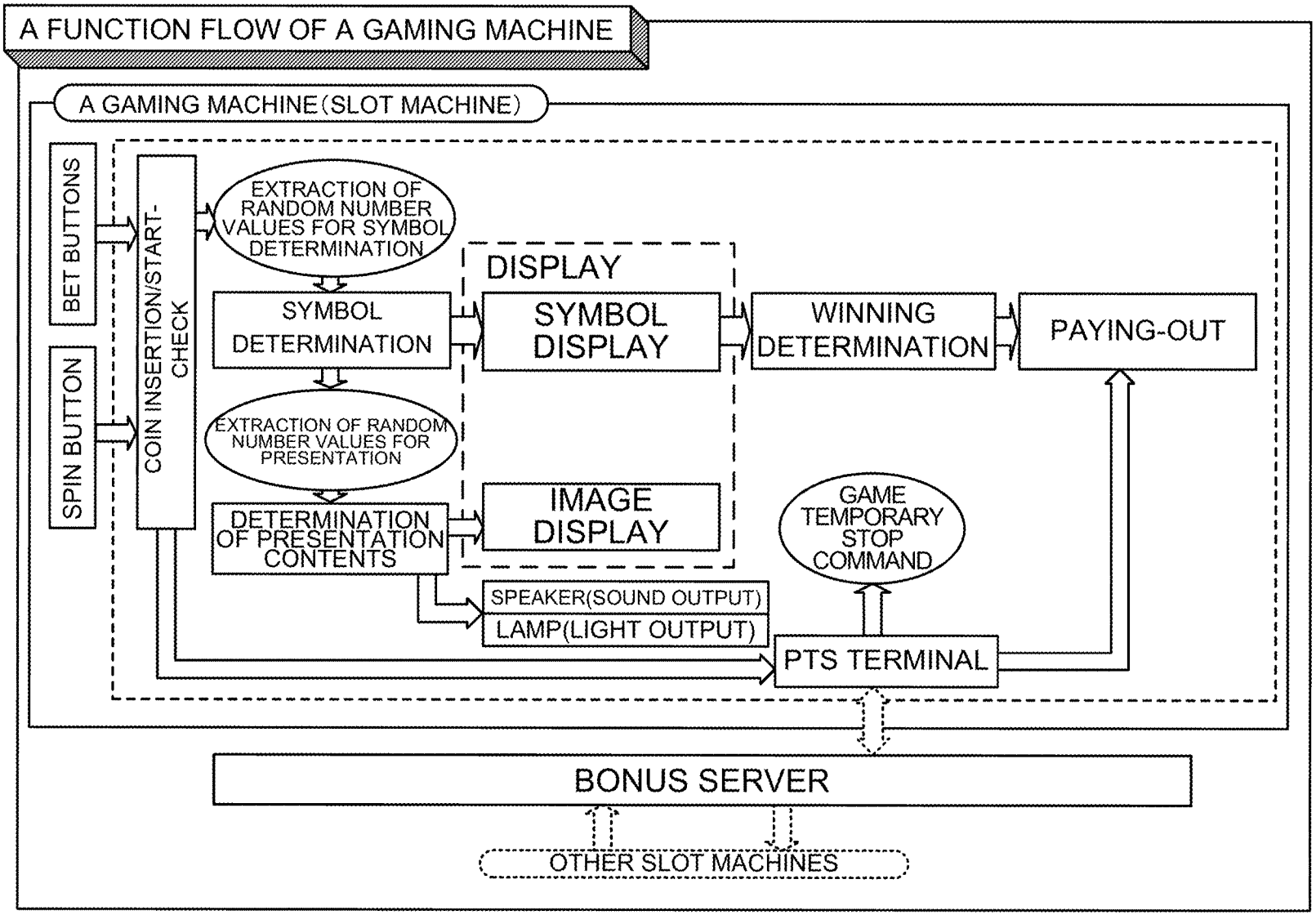
FIG. 3 is a diagram showing basic functions of the slot machine according to the one embodiment of the present invention.

With reference to FIG. 3, basic functions of a slot machine according to one embodiment of the present invention will be described. As shown in FIG. 3, the slot machine 1010 is connected to an external control device (for example, a bonus server 11) so as to allow data communication, and the external control device is connected to a plurality of other slot machines 1010 installed in a hall so as to allow data communication.

<Coin-Insertion/Start-Check>

First, the slot machine 1010 checks whether or not a BET button has been pressed by a player and subsequently checks whether or not a spin button has been pressed by a player.

<Symbol Determination>

Next, when the spin button has been pressed by a player, the slot machine 1010 extracts random number values for symbol determination and determines symbols to be displayed to a player with respect to a plurality of video reels displayed on a display at the time of stopping scrolling of symbol arrays.

<Symbol Display>

Next, the slot machine 1010 starts scrolling of the symbol array of each of the video reels and then stops the scrolling such that the determined symbols are displayed to a player.

<Winning Determination>

Next, when the scrolling of each of the video reels has been stopped, the slot machine 1010 determines whether or not a combination of symbols displayed to a player is a combination related to winning.

<Paying-Out>

Next, when the symbols displayed to a player is the combination related to the winning, the slot machine 1010 provides a benefit according to the combination for a player. For example, when a combination of symbols related to paying-out of coins has been displayed, the slot machine 1010 pays out to a player a number of coins corresponding to the combination of symbols.

In addition, on the slot machine 1010, in a case where the spin button has been pressed by a player and a unit game has been thereby started and in a case where the unit game has been terminated, in response thereto, a drawing for a bonus game is conducted on the bonus server 11. When as an outcome of the drawing for the bonus game, winning has occurred on any of the slot machines 1010, the unit game is stopped on the slot machine 10 and thereafter, linkage presentation is conducted on the PTS terminals 1700. Here, the unit game refers to a series of operations conducted from when the acceptance of betting is started to when winning is likely to be established.

On any of the slot machines 1010 which has won in the bonus game, paying-out is conducted from the bonus server 11 via the PTS terminal 1700. In addition, the bonus server 11 accumulates, for example, one part of a credit consumed by a player on each of the slot machines 1010 as a credit, for example, for a progressive bonus and when any of the slot machines 1010 has won in the bonus game, pays out one part of the progressive bonus to that slot machine 1010.

<Determination of Presentation>

The slot machine 1010 conducts presentation through displaying of images by a display, outputting of light by a lamp, and outputting of sound by a speaker. The slot machine 1010 extracts a random number value for the presentation and determines presentation contents based on symbols or the like determined by a drawing.

In addition, upon the drawing for the bonus game, the linkage presentation is conducted over the plurality of gaming machines by display devices, light emitting parts, and speakers of the PTS terminals 1700.

[Overall Structure of Slot Machine]

Figure 4:
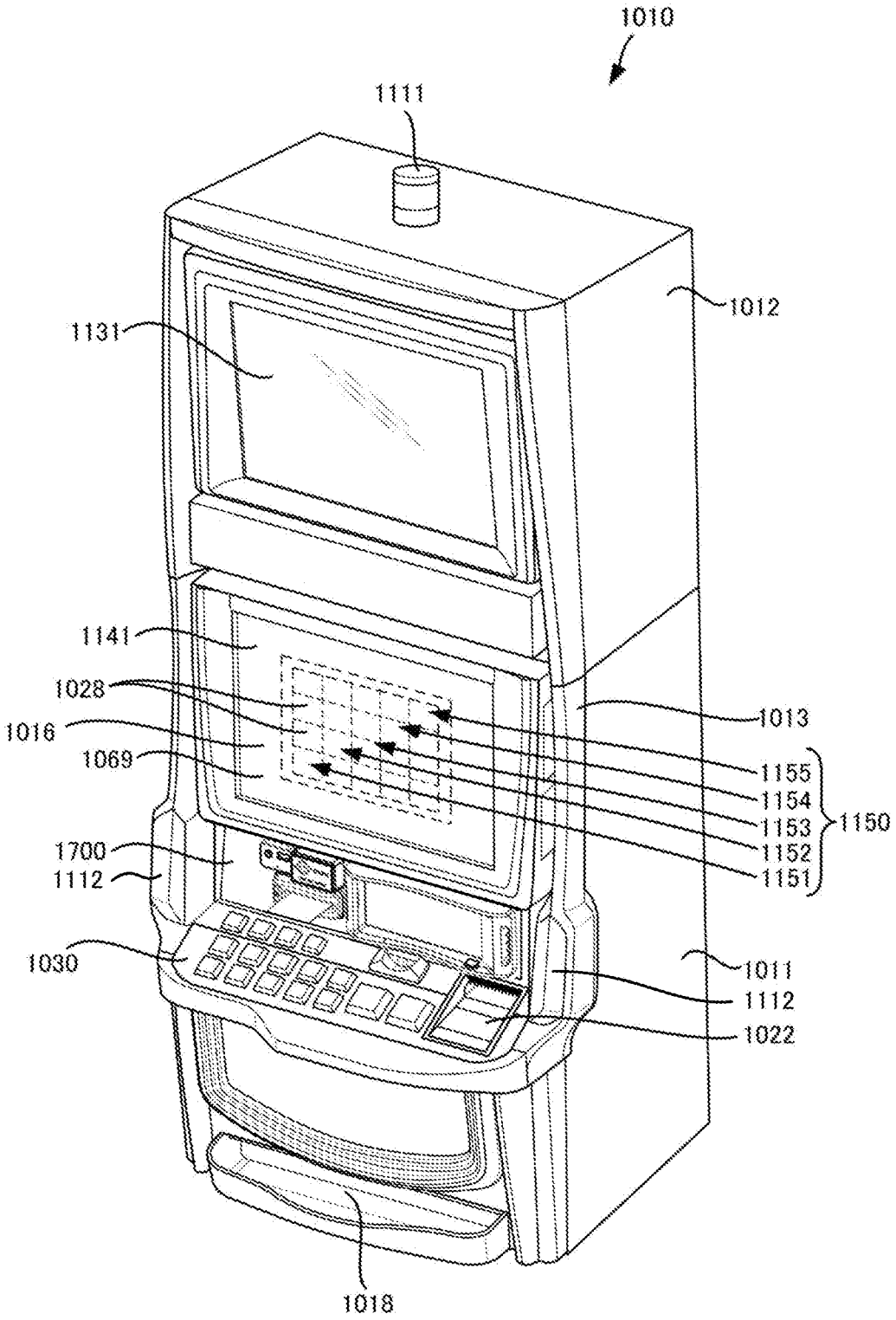
FIG. 4 is a view illustrating an overall structure of the slot machine according to the one embodiment of the present invention.

Next, with reference to FIG. 4, an overall structure of a slot machine 1010 will be described.

On the slot machine 1010, as game media, coins, bills, or electronic valuable information corresponding to these are used. In particular, in the present embodiment, credit-related data such as cash data stored in an IC card 1500 is used.

The slot machine 1010 includes: a cabinet 1011; a top box 1012 attached on an upper side of the cabinet 1011; and a main door 1013 provided on a front face of the cabinet 1011.

On the main door 1013, a symbol display device 1016 which is referred to as a lower image display panel 1141 is provided. The symbol display device 1016 is formed of a transparent liquid crystal panel. A screen which the symbol display device 1016 displays has a display window 1150 in the central portion thereof. The display window 1150 is constituted of 20 display blocks 1028 of 5 columns×4 rows. Four display blocks 1028 of each of the columns form each of pseudo reels 1151 to 1155 and are rotated in response to an operation by a player. The respective pseudo reels 1151 to 1155 allow rearrangement of symbols such that the four display blocks 1028 of each thereof are displayed in a downwardly moving manner while wholly changing a speed, thereby rotating symbols 1501 displayed in the respective display blocks 1028 in a longitudinal direction and thereafter, the rotation is stopped.

Here, the "rearrangement" means a state in which after the arrangement of the symbols 1501 has been released, the symbols 1501 are arranged again. "Arrangement" means a state in which the symbols 1501 can be visually confirmed by an external player. The slot machine 1010 executes the so-called slot game in which based on the state of the arrangement of the symbols 1501 on the pseudo reels 1151 to 1155 which have been rotated and thereafter stopped, a payout in accordance with a predetermined combination is awarded.

It is to be noted that although in the present embodiment, a case where the slot machine 1010 is the so-called video slot machine is described, on the slot machine 1010 according to the present invention, the so-called mechanical reels may be substituted for one part of the pseudo reels 1151 to 1155.

Further, on a front face of the symbol display device 1016, a touch panel 1069 is provided, and a player operates the touch panel 1069, thereby allowing a variety of instructions to be inputted. An input signal is transmitted from the touch panel 1069 to a main CPU 1071.

On a front face of the top box 1012, an upper image display panel 1131 is provided. The upper image display panel 1131 is constituted of a liquid crystal panel and configures a display. The upper image display panel 1131 displays images related to presentation and images showing introduction of contents of games and rules thereof. In addition, on the top box 1012, speakers 1112 and a lamp 1111 are provided. On the slot machine 1010, presentation in a unit game is executed through displaying of images, outputting of sound, and outputting of light.

In addition, above the display window 1150, a number-of-credits display part (not shown) is displayed and a current number of credits is displayed therein. Here, "credits" are virtual game media on a game, to be used when a player makes betting. It is to be noted that in the number-of-credits display part, a total number of credits which a player currently has is displayed.

In addition, below the number-of-credits display part, a fraction cash display part (not shown) is displayed. In the fraction cash display part, fraction cash is displayed. The "fraction cash" is cash which is not converted to a credit because an inputted money amount is insufficient.

When the IC card 1500 is inserted into the later-described PTS terminal 1700, a number of credits stored on the IC card is displayed on the number-of-credits display part, and fraction cash stored on the IC card is displayed on the fraction cash display part. It is to be noted that these numerical values are stored on the membership management server 13 so as to be associated with an identification code of the membership card.

Here, the IC card is, for example, a non-contact IC card and has incorporated thereon an IC (Integrated Circuit) for recording and computing a variety of pieces of data such as credits and enables short-range wireless communication using an RFID (Radio Frequency Identification) technology such as NFC (Near Field Communication), for example. By using the IC card 1500, a player can have the credit-related data and further, can freely carry this with him or her among different slot machines. A player inserts the IC card 1500 into the PTS terminal 1700 of the slot machine 1010 and thereby uses the credit-related data (money amount data) stored on the IC card 1500, thereby allowing a player to play a game such as a unit game on the slot machine 1010.

It is to be noted that it may be made possible for a player to deposit cash such as coins and bills as cash data on the IC card 1500 by using an apparatus installed in a hall.

In addition, below the lower image display panel 1141, the PTS terminal 1700 is incorporated into the cabinet 1011. Further, on right and left sides besides the PTS terminal 1700, speakers 1112 are provided, respectively. On an upper portion of the top box 1012, a lamp 1111 is provided. On the slot machine 1010, presentation in a unit game is executed through displaying of images by the upper image display panel 1131, outputting of sound by the speakers 1112, outputting of light by the lamp 1111, and the like.

[Configuration of PTS Terminal]

Figure 5:
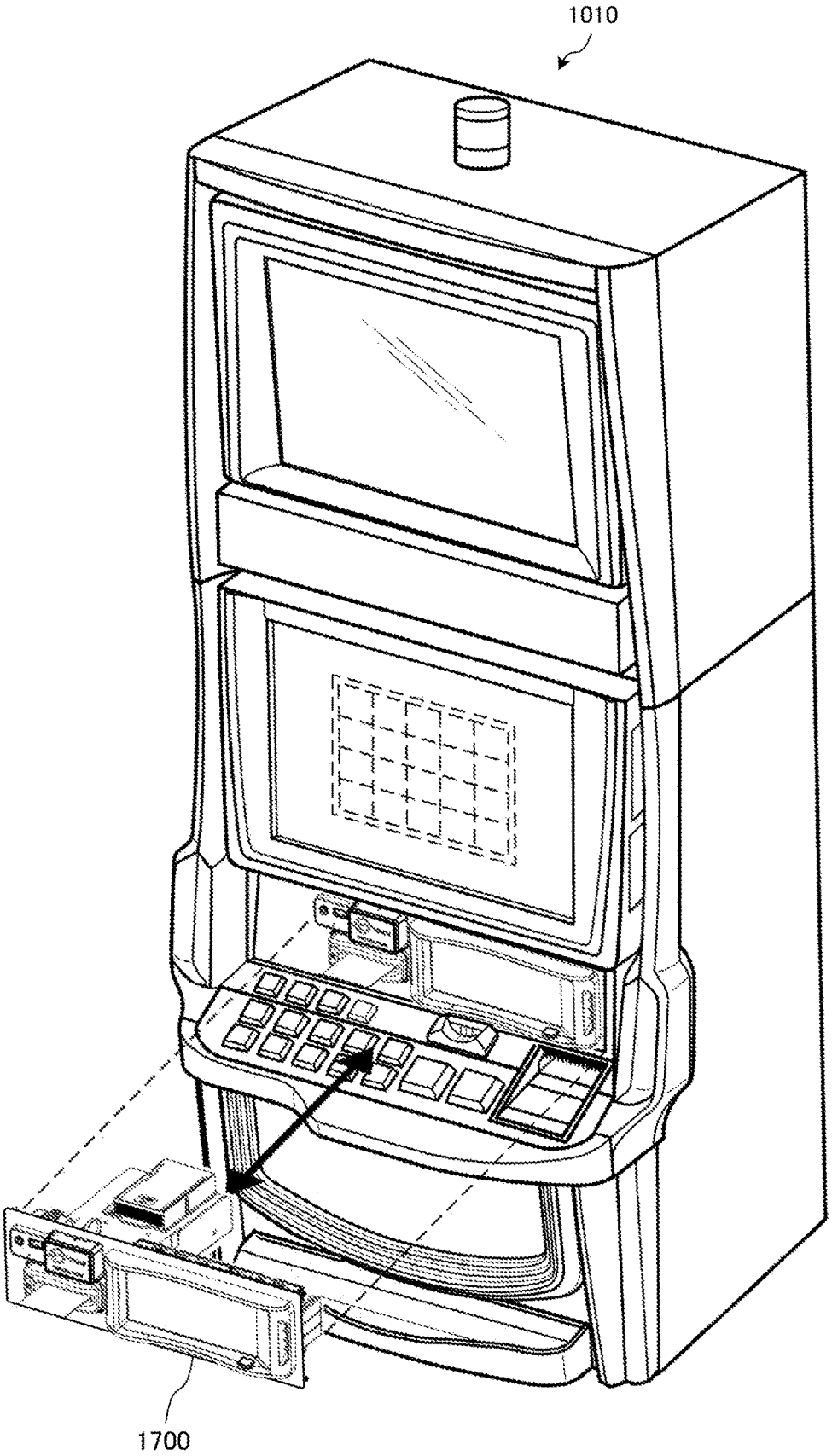
FIG. 5 is a view illustrating a PTS terminal which is incorporated into the slot machine according to the one embodiment of the present invention.

FIG. 5 is a diagram illustrating a PTS terminal 1700 incorporated into a slot machine 1010. The PTS terminal 1700 uses a data interface which is commonalized for gaming machines to communicate data and can be thereby incorporated into a variety of types of gaming machines manufactured by a variety of makers.

Figure 6:
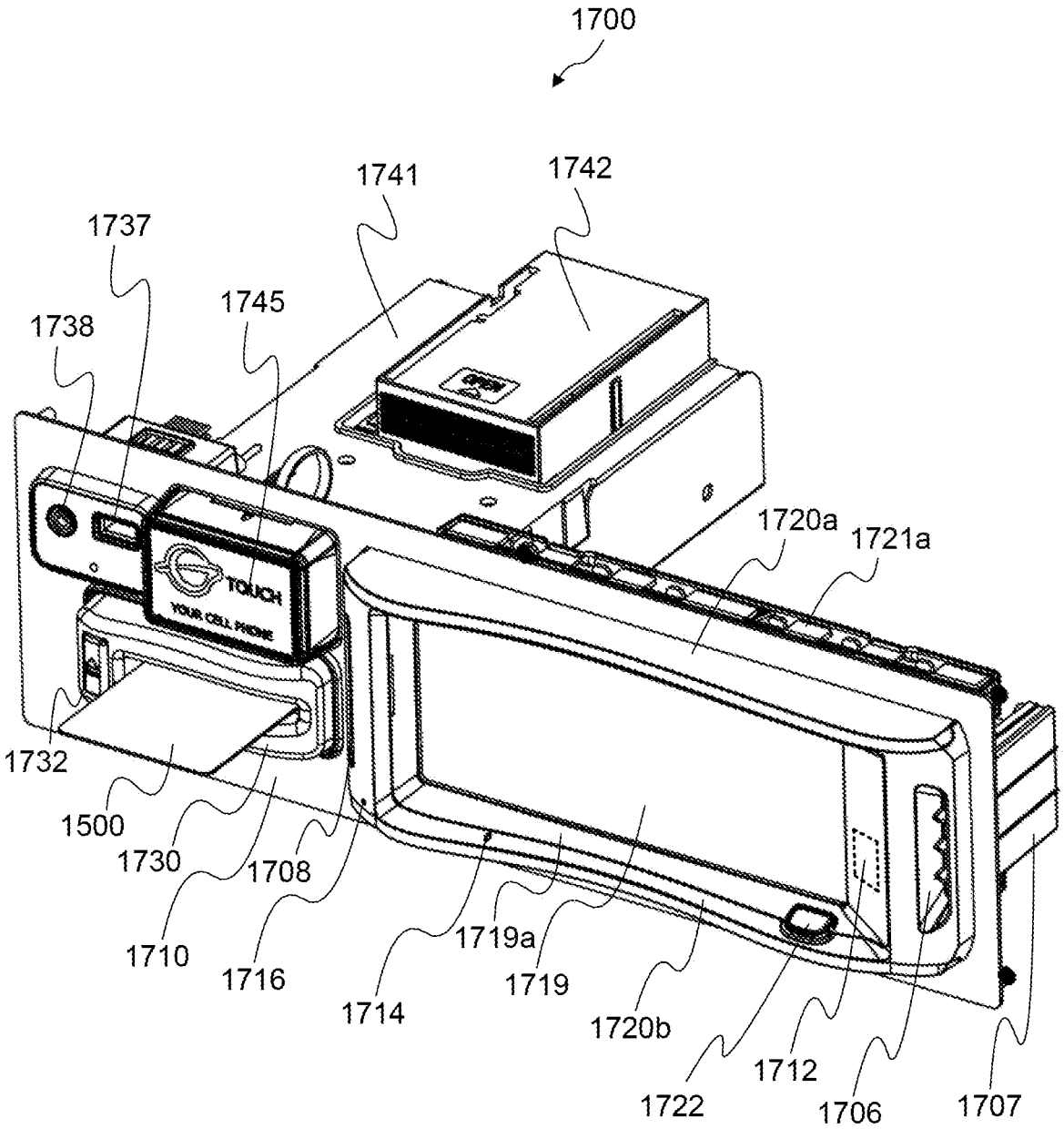
FIG. 6 is a view illustrating the PTS terminal according to the one embodiment of the present invention in an enlarged manner.

FIG. 6 is an enlarged view of the PTS terminal 1700 shown in FIG. 5. As shown in FIG. 6, the PTS terminal 1700 has a panel 1710, respective parts located on a front face of the panel 1710 are viewable by a player, and members located on a rear face of the panel 1710 are housed inside of the cabinet 1011 of the slot machine 1010 and are not viewable by a player.

On a right side of the front face of the panel 1710, an LCD 1719 having a touch panel function is provided. The LCD 1719 displays, for example, information related to members and information for members, and a size of a screen thereof is 6.2 inches (approximately 15.7 cm). In addition, around the LCD 1719, an LCD cover **1719*a* is provided. It is to be noted that although in this example, the LCD 1719** is configured to have the touch panel function, instructions issued by a player may be inputted with other input devices such as a keyboard and a mouse.

In addition, above the LCD 1719 and the LCD cover **1719*a*, a light emitting plate 1720*a* which is connected to LEDs and emits light is provided. The light emitting plate 1720*a* is formed of, for example, polycarbonate and is connected to a plurality of (for example, seven) full-color LEDs 1721*a* located on a rear side of the panel 1710 and emits light in accordance with light emitting of the full-color LEDs 1721*a***.

Below the LCD 1719 and the LCD cover **1719*a*, similarly, a light emitting plate 170*b* which is connected to LEDs and emits light is provided. The light emitting plate 170*b* is formed of, for example, polycarbonate and is connected to a plurality of (for example, seven) full-color LEDs 1721*b* (not shown) located on the rear side of the panel 1710 and emits light in accordance with light emitting of the full-color LEDs 1721*b***.

In addition, on a right side of the LCD 1719, an image pickup window 1712 is provided, and a human body detection camera 1713 (not shown) located inside of the LCD cover **1719*a* or on the rear side of the panel 1710 shoots an image of a player via this image pickup window 1712. The image pickup window 1712** may be also formed of, for example, a half mirror material which has undergone shield processing such as smoke processing.

In addition, at a position of the LCD cover 1719*a*, which is below the LCD 1719 and is on a right side, a home button 1722 is provided. The home button 1722 is a button to shift a screen displayed on the LCD 1719 to a predetermined upper level screen.

Further, at a position of the LCD cover 1719*a*, which is on the right side of the LCD 1719, a speaker duct 1706 is provided, and in a position on the rear side of the panel 1710, which corresponds to a position of the speaker duct 1706, a bass reflex type speaker 1707 is provided. Similarly, on a left side of the LCD 1719, a speaker duct 1708 is provided, and in a position on the rear side of the panel 1710, which corresponds to a position of the speaker duct 1708, a bass reflex type speaker 1709 (not shown) is provided. These speakers are speakers dedicated to the PTS terminal 1700 and are provided separately from the speakers 1112 for a slot machine game provided on the slot machine 1010. These speakers are capable of realizing linkage presentation and a phone call by voice and of outputting notification sound for notifying a player that an IC card 1500 is left unremoved. It is to be noted that since the configuration thereof is made such that sound from the speakers passes through the above-described speaker ducts 1706 and 1708 and is heard in front thereof (on a player side) in a stereophonic manner, the speakers can be installed on the rear side of the panel 1710 and as a result, space-saving of the PTS 1700 (panel face) can be realized.

In addition, at positions of the LCD cover 1719*a*, which are below the LCD 1719 and are on a left side, a microphone opening 1714 and a microphone opening 1716 are provided. In portions corresponding to the microphone opening 1714 and the microphone opening 1716 inside of the LCD cover 1719*a*, microphones 1715 and 1717 (not shown) are provided, respectively.

In a left lower portion of the front face of the panel 1710, a card insertion slot 1730 which allows an IC card 1500 to be inserted thereto and removed therefrom is provided. In a card insertion part of the card insertion slot 1730, full-color LEDs 1731 (not shown) are provided, which are lit up in a plurality of colors, thereby allowing the remaining number of IC cards 1500 stacked in the later-described card stacker 1742 to be notified. At the card insertion slot 1730, an eject button 1732 is provided, and in the vicinity of the eject button 1732, an LED 1733 (not shown) is provided, which is lit up in red, thereby allowing a position and a way of an ejection operation of the eject button 1732 to be found.

In addition, in positions on a rear side of the panel 1710, which correspond to the card insertion slot 1730, a card unit 1741 and the card stacker 1742 are provided, and the card insertion slot 1730 is configured as one part of the card unit 1741. In the card stacker 1742, approximately 30 IC cards 1500 can be retained, and when a player who has newly played a unit game makes settlement of credits, an IC card 1500 retained in the card stacker 1742 is taken out and ejected to the card insertion slot 1730.

For the IC card 1500 taken in from the card insertion slot 1730 and retained in the card unit 1741, upon the settlement of credits, credit information is updated by NFC or the like, and thereafter, the IC card 1500 is ejected from the card insertion slot 1730. While a player is playing a unit game, the IC card 1500 is completely housed inside of the card unit 1741.

In addition, in a case where upon the settlement of credits, in spite of the IC card 1500 left unremoved, absence of a player is detected by the human body detection camera or the like, the configuration may also be arranged such that the IC card 1500 can be retained in the card stacker 1742. Thus, for example, even in a case where a player has learned that the remaining number of credits is small and yet has left his or her seat with the IC card 1500 left unremoved or in a case where a player has simply forgotten to remove the IC card 1500 and has left his or her seat, it does not occur that the IC card 1500 is left retained in the card unit 1741 over a long period of time.

In positions on a left upper side of the front face of the panel 1710, a USB terminal 1737 and an audio terminal 1738 are provided. The USB terminal 1737 is configured to allow battery charge or the like by connecting a USB device thereto. In addition, the audio terminal 1738 is, for example, a four-pole terminal, and a headset is inserted thereto, thereby allowing a phone call with other person to be made with the headphones and the microphones. In addition, the audio terminal 1738 may be configured to be a two-pole or three-pole terminal, thereby allowing sound to be listened with the headphones.

On the front face of the panel 1710 and on the left side of the LCD 1719, a touch unit 1745 is provided. The touch unit 1745 includes an RFID module which can function as a writer to write data through data communication to an IC device including an IC chip (for example, a non-contact IC card, a mobile phone and a smartphone, each of which has a communication function by NFC, and the like) and which can function as a reader to read data through the data communication from said IC device. In addition, in four corners of the front face of the touch unit 1745, LEDs 1746 (not shown) are located, respectively. In addition, besides the touch unit 1745 or instead of the touch unit 1745, an information recording medium reading device for reading information stored in an information recording medium such as a magnetic card may be provided. In this case, instead of the IC card 1500, the magnetic card may be a membership card.

As described above, the PTS terminal 1700 according to the one embodiment of the present invention is formed such that the variety of devices having the microphone function, the camera function, the speaker function, the display function, and the like are integrated into one unit, thus realizing space-saving. This allows avoiding of inconvenience, for example, in that by mounting respectively single parts having the above-mentioned functions, if the LCD is mounted so as to face a player, the speakers cannot be mounted so as to face a player.

[Advantage of Mounting Both of Card Unit and Touch Unit]

In addition, the PTS terminal 1700 according to the one embodiment of the present invention is configured such that upon inserting an IC card 1500 into a card insertion slot 1730, contents of the IC card 1500 is read by a card unit 1741, and the whole IC card 1500 is taken in (inside of the PTS terminal 1700) and is held thereinside. In addition thereto, a touch unit 1745 is provided and this allows data communication with another IC card, a mobile phone, and a smartphone.

By employing the above-described configuration of the PTS terminal 1700 according to the present invention, for example, in a case where while a player who is a member is playing a game on a gaming machine (at this time, a membership card is held in the card unit 1741), when some maintenance comes to be required, a staff member touches an IC card for maintenance onto this touch unit 1745, thereby enabling a screen for the maintenance to be displayed on an LCD 1719 of the PTS terminal 1700 and contents and a history of the maintenance to be transmitted to a server and stored thereon.

In addition, for example, in a case where maintenance for a plurality of gaming machines is simultaneously conducted or maintenance for a large number of gaming machines is continuously conducted, a staff member consecutively touches the card for maintenance onto these touch units 1745, thereby allowing operations of displaying the screen for maintenance, registering of contents of maintenance, and the like to be quickly performed.

On the other hand, if the PTS terminal 1700 is configured such that only the touch unit 1745 enables access to an IC card or the like, when after a player playing a game by initially touching an IC card 1500 thereonto has left a gaming machine, another player uses that gaming machine, the gaming machine cannot recognize switching of a player. Also in order to solve such inconvenience, the card unit 1741 which holds the IC card 1500 during a game is required. For example, if after a player playing a game by initially touching an IC card 1500 thereonto has left a gaming machine, another player plays a game on that gaming machine by inputting bills (without using any IC card) and makes settlement, credit-related data is stored on the IC card 1500 of the initial player.

[Configuration of Circuitry Included in Slot Machine]

Figure 7:
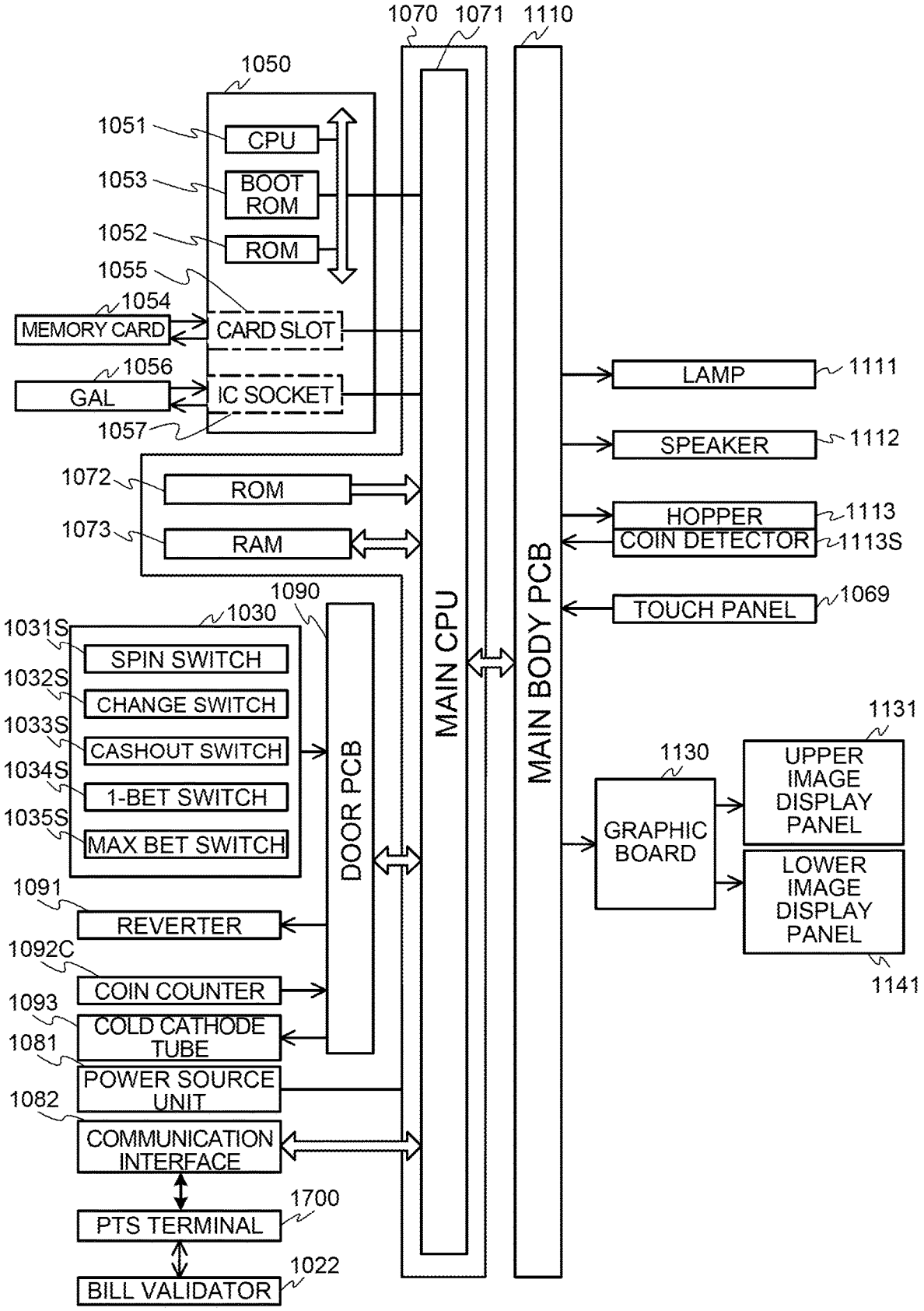
FIG. 7 is a diagram showing a circuitry configuration of the slot machine according to the one embodiment of the present invention.

Next, with reference to FIG. 7, a configuration of circuitry included in a slot machine 1010 will be described.

A gaming board 1050 is provided with: a CPU 1051, a ROM 1052, and a boot ROM 1053, which are mutually connected by an internal bus; a card slot 1055 corresponding to a memory card 1054; and an IC socket 1057 corresponding to a GAL (Generic Array Logic) 1056.

The memory card 1054 includes a non-volatile memory and stores a game program and a game system program. The game program includes a program related to game progression and a program for producing presentation by images and sounds. In addition, the above-mentioned game program includes a symbol determination program. The symbol determination program is a program for determining symbols to be rearranged in display blocks 1028.

In addition, the card slot 1055 is configured such that the memory card 1054 can be inserted thereinto and removed therefrom and is connected to a motherboard 1070 by an IDE bus. Accordingly, the memory card 1054 is pulled out from the card slot 1055, another game program is written into the memory card 1054, and that memory card 1054 is inserted into the card slot 1055, thereby allowing a kind and contents of a game played on the slot machine 1010 to be changed.

The GAL 1056 is a type of a PLD (Programmable Logic Device) having a fixed OR array structure. The GAL 1056 is provided with a plurality of input ports and output ports, and predetermined input into the input port causes output of the corresponding data from the output port.

In addition, the IC socket 1057 is configured such that the GAL 1056 can be inserted thereinto and removed therefrom and is connected to the motherboard 1070 by a PCI bus. The contents of the game to be played on the slot machine 1010 can be changed by replacing the memory card 1054 with another memory card 1054 having another program written therein or by rewriting the program written into the memory card 1054 as another program.

The CPU 1051, the ROM 1052, and the boot ROM 1053 mutually connected by the internal bus are connected to the motherboard 1070 by a PCI bus. The PCI bus enables a signal transmission between the motherboard 1070 and the gaming board 1050 and power supply from the motherboard 1070 to the gaming board 1050.

The ROM 1052 stores an authentication program. The boot ROM 1053 stores a pre-authentication program, a program (boot code) to be used by the CPU 1051 for activating the pre-authentication program, and the like.

The authentication program is a program (tamper check program) for authenticating the game program and the game system program. The pre-authentication program is a program for authenticating the above-mentioned authentication program. The authentication program and the pre-authentication program are written along a procedure (authentication procedure) for proving that the program to be the subject has not been tampered.

The mother board 1070 is configured by using a commercially available general-purpose mother board (printed circuit board having basic components of a personal computer mounted thereon) and includes a main CPU 1071, a ROM (Read Only Memory) 1072, a RAM (Random Access Memory) 1073, and a communication interface 1082. It is to be noted that the main CPU 1071 corresponds to a controller 1100 of the slot machine 1010.

The ROM 1072 includes a memory device such as a flash memory and stores a program such as BIOS (Basic Input/Output System) to be executed by the main CPU 1071 and permanent data. When the BIOS is executed by the main CPU 1071, processing for initializing predetermined peripheral devices is conducted; and further, through the gaming board 1050, processing of loading the game program and the game system program stored in the memory card 1054 is started. It is to be noted that in the present invention, the ROM 1072 may be a ROM in which contents are rewritable or a ROM in which contents are un-rewritable.

The RAM 1073 stores data and programs such as the symbol determination program which are used in operation of the main CPU 1071. For example, when the processing of loading the above-mentioned game program, game system program, or authentication program is conducted, the RAM 1073 can store the program. The RAM 1073 is provided with working areas used for operations in execution of these programs. Examples of the areas include: an area that stores counters for managing the number of games, the number of BETs, the number of payout, the number of credits, and the like; and an area that stores symbols (code numbers) determined by a drawing.

The communication interface 1082 is to control transmission and reception of data with the PTS terminal 1700. In addition, the motherboard 1070 is connected with the later-described door PCB (Printed Circuit Board) 1090 and a main body PCB 1110 by respective USBs. The motherboard 1070 is also connected with a power supply unit 1081.

When power is supplied from the power supply unit 1081 to the motherboard 1070, the main CPU 1071 of the motherboard 1070 is activated, and then the power is supplied to the gaming board 1050 through the PCI bus so as to activate the CPU 1051.

The door PCB 1090 and the main PCB 1110 are connected with input devices such as switches and sensors and peripheral devices, the operations of which are controlled by the main CPU 1071.

The door PCB 1090 is connected with a control panel 1030, a reverter 1091, a coin counter 1092C, and a cold cathode tube 1093.

The control panel 1030 is provided with a spin switch 1031S, a change switch 1032S, a CASHOUT switch 1033S, a 1-BET switch 1034S, and a MAX-BET switch 1035S which correspond to the above-mentioned respective buttons. Each of the switches outputs a signal to the main CPU 1071 upon detection of pressing of the button corresponding thereto by a player.

Inside of a coin entry 1036, the reverter 1091 and the coin counter 1092C are provided. The reverter 1091 identifies whether or not coins inputted into the coin entry 1036 are authentic and discharges coins other than authentic coins from a coin payout outlet. In addition, the reverter 1091 detects authentic coins accepted by the coin counter 1092C and counts a number of the accepted authentic coins.

The reverter 1091 operates based on a control signal outputted from the main CPU 1071 and distributes authentic coins validated by the coin counter 1092C into a hopper 1113 or a cash box (not shown). That is, coins are distributed into the hopper 1113 when the hopper 1113 is not filled with coins, while coins are distributed into the cash box when the hopper 1113 is filled with coins.

The cold cathode tube 1093 functions as a backlight installed on the rear face sides of the upper image display panel 1131 and the lower image display panel 1141 and lights up based on a control signal outputted from the main CPU 1071.

The main body PCB 1110 is connected with the lamp 1111, the speaker 1112, the hopper 1113, a coin detecting part 1113S, a touch panel 1069, and a graphic board 1130. It is to be noted that although in this example, the bill validator 1022 is connected to the PTS terminal 1700, the bill validator 1022 may be configured to be connected to the slot machine 1010.

The lamp 1111 lights up based on a control signal outputted from the main CPU 1071. The speaker 1112 outputs sound such as BGM based on a control signal outputted from the main CPU 1071.

The hopper 1113 operates based on a control signal outputted from the main CPU 1071 and pays out the specified number of coins from the coin payout outlet to a coin tray 1018. The coin detecting part 1113S outputs a signal to the main CPU 1071 upon detection of coins paid out by the hopper 1113.

The touch panel 1069 detects a position on the lower image display panel 1141 touched by a player's finger or the like and outputs to the main CPU 1071 a signal corresponding to the detected position.

The bill validator 1022 identifies whether or not bills are authentic and accepts authentic bills into the cabinet 1011. An amount of the bills inputted into the cabinet 1011 is converted to a number of coins and a credit which is equivalent to the converted number of coins is added as a credit which a player has.

The graphic board 1130 controls display of images conducted by each of the respective upper image display panel 1131 and lower image display panel 1141 based on a control signal outputted from the main CPU 1071. The graphic board 1130 is provided with a VDP (Video Display Processor) generating image data, a video RAM storing the image data generated by the VDP, and the like. It is to be noted that the image data used in generation of image data by the VDP is included in the game program which has been read from the memory card 1054 and stored into the RAM 1073.

In addition, the graphic board 1130 is provided with the VDP (Video Display Processor) generating image data based on a control signal outputted from the main CPU 1071, the video RAM temporarily storing the image data generated by the VDP, and the like. It is to be noted that the image data used in generation of image data by the VDP is included in the game program that has been read from the memory card 1054 and stored into the RAM 1073.

[Circuitry Configuration of PTS Terminal]

Figure 8:
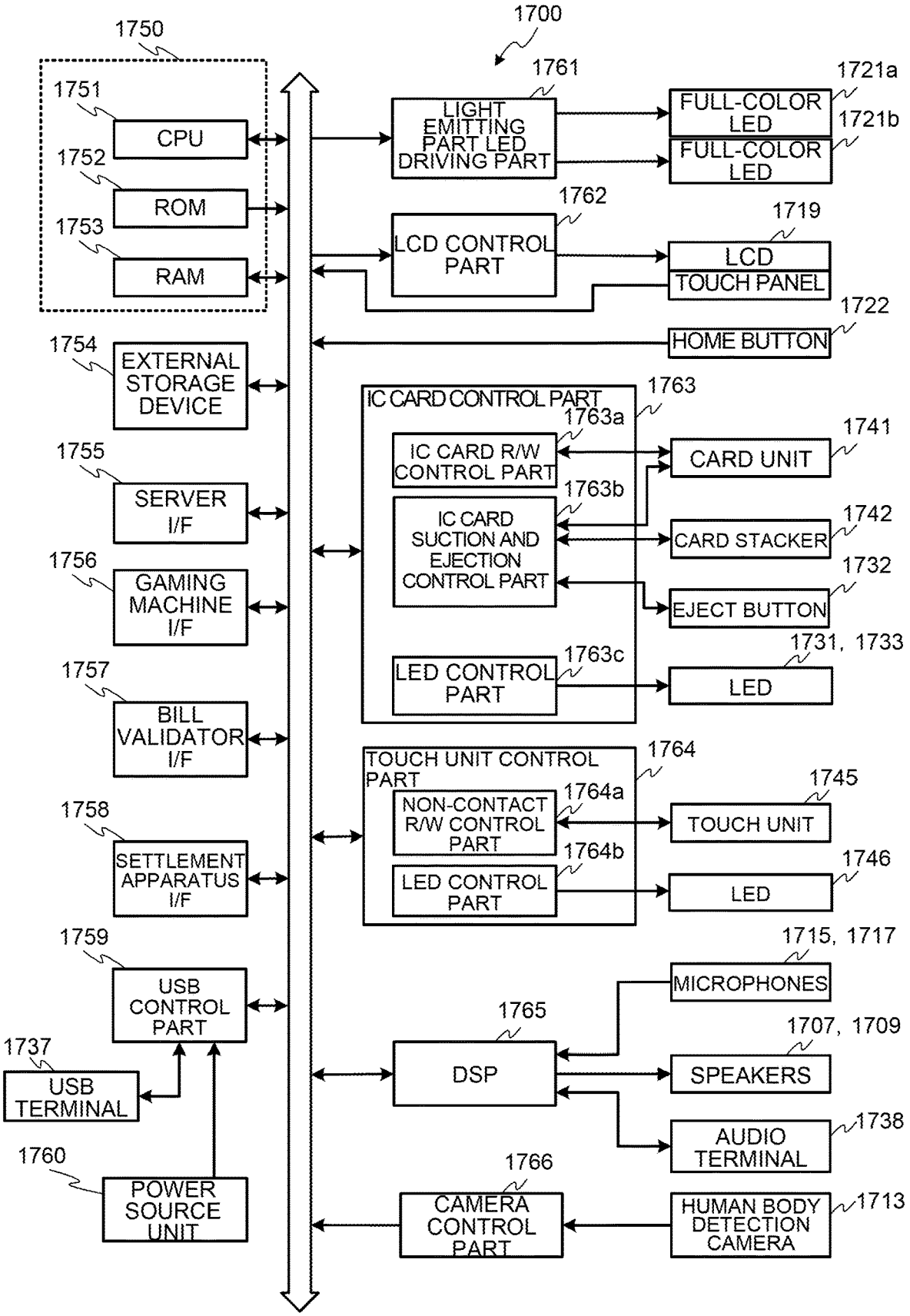
FIG. 8 is a diagram showing a circuitry configuration of the PTS terminal according to the one embodiment of the present invention.

Next, with reference to FIG. 8, a configuration of circuitry which a PTS terminal 1700 includes will be described.

A PTS controller 1750 for controlling the PTS terminal 1700 has a CPU 1751, a ROM 1752, and a RAM 1753.

The CPU 1751 controls execution of each component of the PTS terminal 1700, executes a variety of programs stored in the ROM 1752, and performs computation. For example, the CPU 1751 executes a credit updating program and updates credit-related data stored in an IC card 1500.

The ROM 1752 is constituted of a memory device such as a flash memory and has stored therein permanent data executed by the CPU 1751. For example, in the ROM 1752, a credit updating program for rewriting credit-related data stored in the IC card 1500, a linkage presentation control program executed in response to a request from a bonus server 11, and the like can be stored.

The RAM 1753 temporarily stores data required upon executing the variety of programs stored in the ROM 1752.

An external storage device 1754 is, for example, a storage device such as a hard disk device and stores the programs executed by the CPU 1751 and data which the programs executed by the CPU 1751 use.

A server I/F (interface) 1755 realizes data communication between servers such as a hall management server 10, the bonus server 11, and the like and the PTS terminal 1700. A gaming machine I/F (interface) 1756 realizes data communication between a controller 1100 of a slot machine 1010 and the PTS terminal 1700, and for said data communication, a prescribed protocol can be used.

Besides, the PTS terminal 1700 is connected to a bill validator 1022 via a bill validator I/F (interface) 1757 and connected to a settlement apparatus 1868 via a settlement apparatus I/F (interface) 1758 and is operable to perform transmission and reception of data as needed.

A USB control part 1759 determines whether on a USB terminal 1737, power is supplied from a power supply unit 1760 and when a predetermined condition is satisfied, enables the recharging on the USB terminal 1737. When the predetermined condition is satisfied, a player connects an electronic device to the USB terminal 1737, thereby allowing said electronic device to be recharged.

A light emitting part LED driving part 1761, in response to a linkage presentation start request from the bonus server 11, performs control such that in order to cause an upper light emitting plate 1720*a* of an LCD 1719 to emit light, full-color LEDs 1721*a* are lit up at predetermined timing and performs control such that in order to cause a lower light emitting plate 170*b* of the LCD 1719 to emit light, full-color LEDs 1721*b* are lit up at predetermined timing.

An LCD control part 1762 performs control to cause the LCD 1719 to display information pertinent to members, information for the members, and the like and to display data read out from an IC card 1500 and data inputted by a player. In addition, the LCD 1719 has a touch panel function and when a touch panel is operated by a player, a predetermined signal is transmitted to the CPU 1751.

A home button 1722 is provided in the vicinity of the LCD 1719 and is a button for shifting a screen displayed on the LCD 1719 to a predetermined upper level screen. When the home button 1722 is pressed by a player, that operation by a player is transmitted to the CPU 1751, and the CPU 1751 transmits an instruction to the LCD control part 1762 to update the display on the LCD 1719 in accordance with said operation.

An IC card control part 1763 performs control for insertion and ejection of an IC card 1500, writing of credit data thereto, and the like. The IC card control part 1763 includes an IC card R/W (reader/writer) control part 1763*a*, an IC card suction and ejection control part 1763*b*, and an LED control part 1763*c*.

The IC card R/W control part 1763*a* controls a card unit 1741 to update credit-related data stored in an IC card 1500. In addition, when an IC card 1500 is newly issued, credit-related data corresponding a settled money amount is stored therein. The card unit 1741 has an antenna part for reading or writing data by NFC or the like from or to an IC card 1500.

Although the card unit 1741 has functions of an IC card reader for reading information stored in an IC card 1500 and an IC card writer for writing information to an IC card 1500, the card unit 1741 may have a function of either one of the IC card reader and the IC card writer as needed.

The IC card suction and ejection control part 1763*b* performs control for suction and ejection of an IC card 1500. When an IC card 1500 is inserted by a player into a card insertion slot 1730, the IC card suction and ejection control part 1763*b* performs control to retain the IC card while a player is executing a game. In addition, after the credit-related data has been written in the IC card 1500 upon the settlement, the IC card suction and ejection control part 1763*b* performs control to eject that IC card 1500. Further, when an eject button 1732 has been pressed, the IC card suction and ejection control part 1763*b* ejects the IC card 1500.

In addition, when an IC card 1500 is newly issued, the IC card suction and ejection control part 1763*b* newly takes out an IC card 1500 from a card stacker 1742 and in order to cause the IC card 1500 to store credit-related data, supplies the IC card 1500 to the card unit 1741.

The LED control part 1763*c* performs control to light up LEDs (full-color LEDs 1731) provided in the vicinity of the card insertion slot 1730 of the card unit 1741 and to light up an LED (red LED 1733) provided in the vicinity of the eject button 1732.

A touch unit control part 1764 controls data transmission and reception associated with a touch operation by an IC card 1500, a mobile phone, a smartphone, or the like. The touch unit control part 1764 includes a non-contact R/W (reader/writer) control part 1764*a* and an LED control part 1764*b*.

The non-contact R/W control part 1764*a* determines whether or not an IC card 1500 or a mobile phone comes within a predetermined distance close to a touch unit 1745 (for example, a touch operation has been conducted thereon) and when the IC card 1500 or the mobile phone has come within the predetermined distance close thereto, the non-contact R/W control part 1764*a* obtains a reading-out result from the touch unit 1745. The touch unit 1745 has an antenna part for performing data transmission and reception to and from the IC card 1500 or the mobile phone by the NFC or the like.

Although the touch unit 1745 has functions of an IC card reader for reading information stored in an IC card 1500 or a mobile phone and an IC card writer for writing information to the IC card 1500 or the mobile phone, the touch unit 1745 may have a function of either one thereof as needed.

The LED control part 1764*b* controls LEDs 1746 located in four corners of a front face of the touch unit 1745 to light up the LEDs 1746 at predetermined timing.

A DSP 1765 receives sound data obtained from microphones 1715 and 1717 and subjects the sound data to predetermined processing and thereafter, transmits the processed data to the CPU 1751. In addition, the DSP 1765 transmits the received sound data to speakers 1707 and 1709. Further, the DSP 1765 outputs, to an audio terminal connected with a headset, the received sound to headphones and processes the sound received from the microphones and transmits the processed sound to the CPU 1751. It is to be noted that here, the configuration of the outline is described and the description on an A/D converter, a D/A converter, an amplifier, and the like is omitted.

A camera control part 1766 obtains an image of a player or the like shot by a human body detection camera 1713, subjects the image to predetermined image processing as needed, and transmit the processed data to the CPU 1751. Said data is transmitted, for example, via the server I/F 1755 to the hall management server 10, a membership management server 13, and the like.

[Configuration of Symbol Combination Table]

Next, with reference to FIG. 9, a symbol combination table will be described. The symbol combination table specifies combinations of drawn symbols related to winning and the numbers of payout. On the slot machine 1010, the scrolling of symbol arrays of five pseudo reels 1151 to 1155 (a first video reel to a fifth video reel) is stopped, and winning is established when the combination of symbols displayed along a winning line matches one of the combinations of symbols specified by the symbol combination table. According to the winning combination, a benefit such as payout of coins is awarded to a player. It is to be noted that winning is not established (i.e. the game is lost) when the combination of symbols displayed along the winning line does not match any of the combinations of symbols specified by the symbol combination table.

Basically, winning is established when all symbols displayed along the winning line by all of the five pseudo reels 1151 to 1155 are of one kind out of kinds of symbols "RED", "APPLE", "BLUE 7", "BELL", "CHERRY", "STRAWBERRY", "PLUM", and "ORANGE". However, with respect to the respective kinds of symbols "CHERRY" and "ORANGE", winning is also established when one or three symbols of either kind are displayed along the winning line by the pseudo reel or the pseudo reels.

For example, when all the symbols displayed along the winning line by all of the five pseudo reels 1151 to 1155 are the symbols "BLUE 7", the winning combination is a "BLUE" combination, and "10" is determined as the number of payout. Based on the determined number of payout, the payout of coins is conducted. The payout of coins is conducted, for example, such that the added credit is stored in the IC card 1500 and thereafter, the IC card 1500 is ejected from the card insertion slot 1730.

[Contents of Programs Executed on Slot Machine]

Next, with reference to FIG. 10 to FIG. 14, programs executed on a slot machine 1010 will be described.

<Main Control Process>

Figure 10:
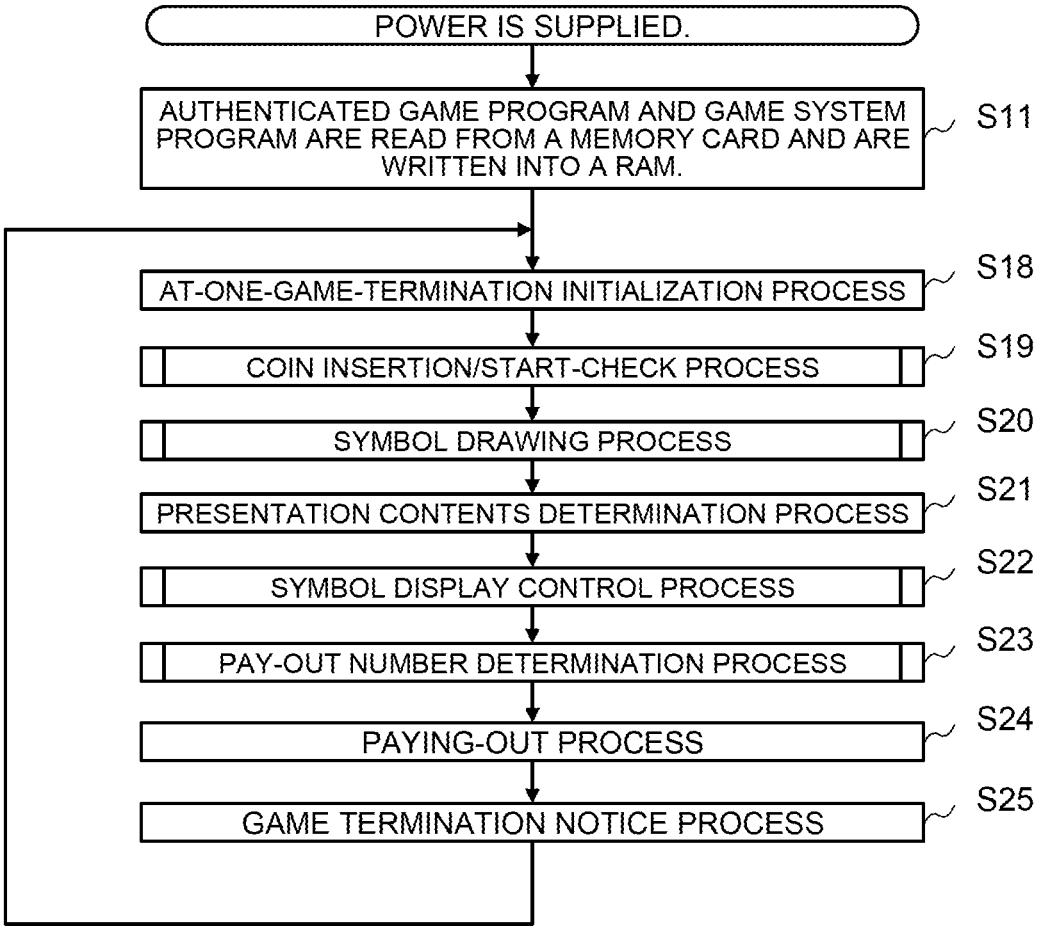
FIG. 10 is a flowchart showing a procedure of a main control process executed on the slot machine according to the one embodiment of the present invention.

First, with reference to FIG. 10, a main control process will be described. First, when power is supplied to the slot machine 1010, a main CPU 1071 reads the authenticated game program and game system program from a memory card 1054 via a gaming board 1050 and writes the programs into a RAM 1073 (step (hereinafter, abbreviated to S) 11).

Next, the main CPU 1071 conducts an at-one-game-termination initialization process (S18). For example, data that becomes unnecessary after each game in working areas of the RAM 1073, such as the number of BETs and the symbols determined by a drawing, is cleared.

Next, the main CPU 1071 conducts a coin insertion/start-check process which is described later (S19). In this process, input from a BET switch and a spin switch is checked.

Next, the main CPU 1071 conducts a symbol drawing process which is described later (S20). In this process, to-be stopped symbols are determined based on random number values for symbol determination.

Next, the main CPU 1071 conducts a presentation contents determination process (S21). The main CPU 1071 extracts a random number value for presentation and determines any of the presentation contents from a predetermined plurality of presentation contents by a drawing. The presentation contents can be determined in accordance with a winning combination and a state of a game on a slot machine 1010. For example, the configuration can be arranged such that in accordance with winning combinations and the states of the game on the slot machine 1010, drawing probabilities related to respective presentation contents are made different from one another.

Next, the main CPU 1071 conducts a symbol display control process which is described later (S22). In this process, the scrolling of five pseudo reels 1151 to 1155 (a first video reel to a fifth video reel) is started, and the to-be stopped symbols determined in the symbol drawing process at S20 are stopped in predetermined positions (for example, in a display window 1150 of a lower image display panel 1141). In other words, with respect to each of the reels, four symbols including each of the to-be stopped symbols are displayed in the display window 1150. For example, when a to-be-stopped symbol is a symbol associated with a code number "10" and it is to be displayed in an upper region, symbols associated with respective code numbers "11", "12", and "13" are to be displayed in an upper central region, a lower central region, and a lower region in the display window 1150, respectively.

Next, the main CPU 1071 conducts a to-be-paid-out number determination process which is described later (S23). In this process, based on a combination of symbols displayed on a winning line L, a to-be-paid-out number is determined and stored in a to-be-paid-out number counter provided in the RAM 1073.

Next, the main CPU 1071 conducts a paying-out process (S24). The main CPU 1071 adds the value stored in the to-be-paid-out number counter to a value stored in a number-of-credits counter provided in the RAM 1073. Here, for example, when a player presses a CASHOUT button, a CASHOUT switch 1033S which has detected the pressing thereof outputs a signal to the main CPU 1071, and a number of credits stored in an IC card 1500 held in a card unit 1741 is updated to a value in the number-of-credits counter.

In addition, driving of a hopper 1113 may be controlled based on input from the CASHOUT switch 1033S, and coins corresponding to the value stored in the to-be-paid-out number counter may be discharged to a coin tray 1018.

Next, the main CPU 1071 conducts a game termination notification process (S25). In this process, data indicating that one unit game has been terminated (together with an identification code or the like of an IC card 1500 in a case where an IC card 1500 or the like has been inserted and a player can be thereby identified) is transmitted to the PTS terminal 1700. The PTS terminal 1700 transmits this data to a hall management server 10, and in response thereto, a bonus server 11 conducts a drawing for a bonus game. After finishing the processing at S25, the main CPU 1071 returns to the processing at S18 and the unit game is repeated.

<Coin-Insertion/Start-Check Process>

Figure 11:
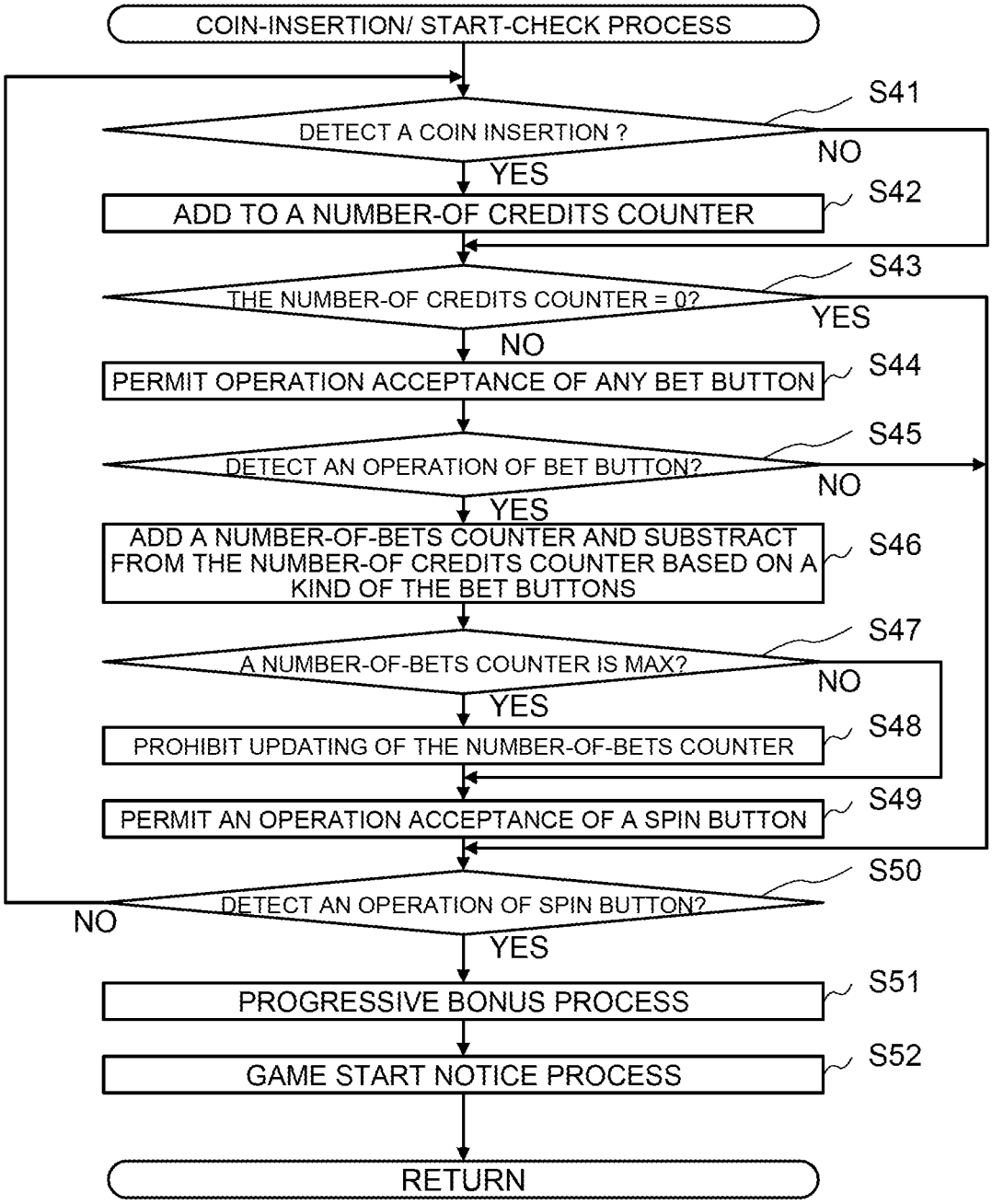
FIG. 11 is a flowchart showing a procedure of a coin-insertion/start-check process executed on the slot machine according to the one embodiment of the present invention.

Next, with reference to FIG. 11, a coin insertion/start-check process will be described. First, a main CPU 1071 determines whether or not insertion of a coin has been detected by a coin counter 1092C (S41). When determining that the insertion of a coin has been detected, the main CPU 71 makes an addition to a number-of-credits counter (S42). Furthermore, in addition to the insertion of a coin, the main CPU 71 determines whether or not insertion of a bill has been detected by a bill validator 1022, and when determining that the insertion of a bill has been detected, the main CPU 71 adds a value corresponding to the bill to the number-of-credits counter.

After the processing at S42 or when determining at S41 that the insertion of the coin or the like has not been detected, the main CPU 1071 determines whether or not a value stored in the number-of-credits counter is zero (S43). When the main CPU 71 determines that the value stored in the number-of-credits counter is not zero, the main CPU 71 permits operation acceptance of a BET button (S44).

Next, the main CPU 1071 determines whether or not operation of any of the BET buttons has been detected (S45). When the pressing of any BET button by a player has been detected by a BET switch, the main CPU 1071 performs addition to a number-of-BETs counter provided in the RAM 1073 and subtraction from the number-of-credits counter based on the kind of the BET button (S46).

Next, the main CPU 1071 determines whether or not a value stored in the number-of-BETs counter is at its maximum (S47). When the main CPU 1071 determines that the value stored in the number-of-BETs counter is at its maximum, the main CPU 1071 prohibits updating of the value stored in the number-of-BETs counter (S48). After S48 or when determining at S47 that the value stored in the number-of-BETs counter is not at its maximum, the main CPU 71 permits operation acceptance of a spin button (S49).

After S49 or when determining at S45 that the operation of any of the BET buttons has not been detected, or when determining at S43 that the value stored in the number-of-credits counter is zero, the main CPU 1071 determines whether or not operation of the spin button has been detected (S50). When the main CPU 1071 determines that the operation of the spin button has not been detected, the main CPU 1071 shifts the processing to S41.

When the main CPU 1071 determines that the operation of the spin button has been detected, the main CPU 1071 conducts a progressive bonus process. In this process, one part of the bet credit is paid out via a PTS terminal 1700 to a bonus server 11, for example, as a credit accumulated for a progressive bonus (S51).

Next, the main CPU 1071 conducts a game start notification process (S52). In this process, data indicating that one unit game is started (together with an identification code or the like of an IC card 1500 in a case where an IC card 1500 or the like has been inserted and a player can be thereby identified) is transmitted to the PTS terminal 1700. The PTS terminal 1700 transmits this data to a hall management server 10, and in response thereto, a bonus server 11 conducts a drawing for a bonus game. After the processing at S52 has been conducted, the coin insertion/start-check process is completed.

<Symbol Drawing Process>

Figure 12:
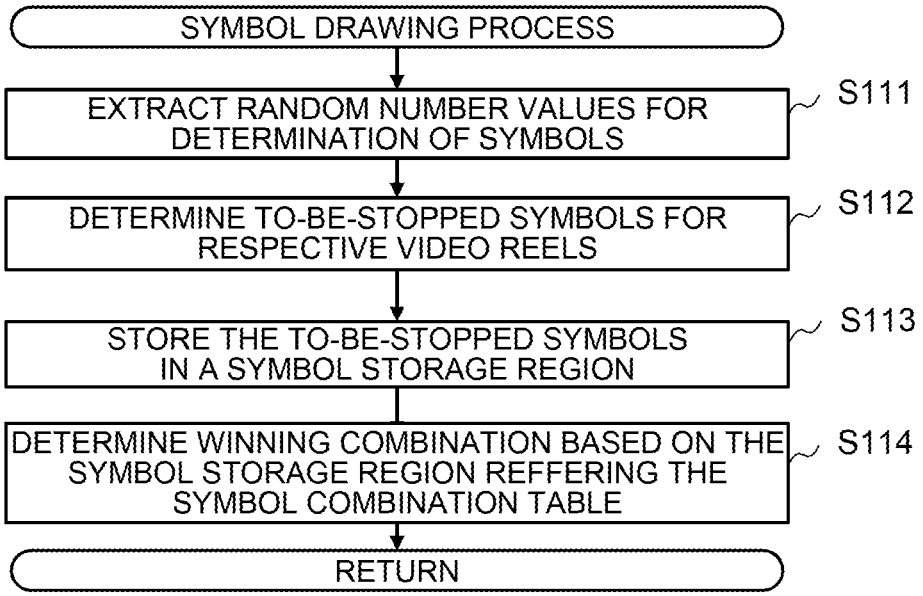
FIG. 12 is a flowchart showing a procedure of a symbol drawing process executed on the slot machine according to the one embodiment of the present invention.

Next, with reference to FIG. 12, a symbol drawing process will be described. First, the main CPU 1071 extracts random number values for symbol determination (S111). Next, the main CPU 1071 determines to-be stopped symbols for five pseudo reels 1151 to 1155 (a first video reel to a fifth video reel) by drawings (S112). The main CPU 1071 conducts a drawing for each of the video reels and determines any of 22 symbols (with code numbers "00" to "21") as to-be stopped symbols. At this time, each of the 22 symbols is determined at an equal probability (i.e. 1/22).

Next, the main CPU 1071 stores the determined to-be stopped symbols for the respective video reels in a symbol storage region provided in the RAM 1073 (S113). Next, the main CPU 1071 references a symbol combination table (FIG. 9) and determines a winning combination based on the symbol storage region (S114). The main CPU 1071 determines whether or not the combination of symbols to be displayed along a winning line by the respective video reels matches any of combinations of symbols specified by the symbol combination table and determines the winning combination. After the process has been conducted, the symbol drawing process is completed.

<Symbol Display Control Process>

Figure 13:
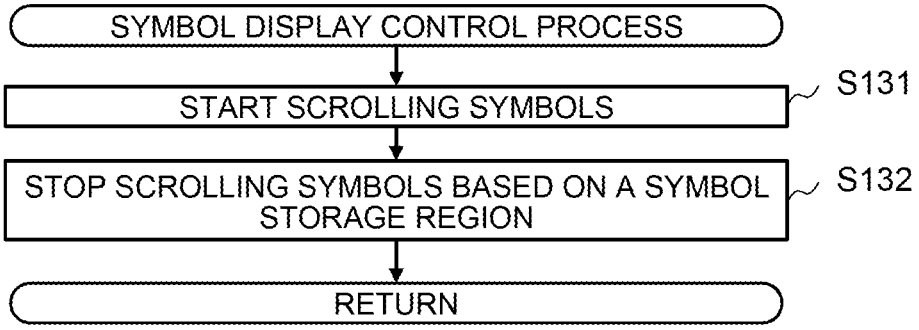
FIG. 13 is a flowchart showing a procedure of a symbol display control process executed on the slot machine according to the one embodiment of the present invention.

Next, with reference to FIG. 13, a symbol display control process will be described. First, a main CPU 1071 starts the scrolling of symbol arrays of respective video reels displayed in a display window 1150 of a lower image display panel 1141 (S131). Next, the main CPU 1071 stops the scrolling of the symbol arrays of the respective video reels based on the above-mentioned symbol storage region (S132). After the process has been conducted, the symbol display control process is completed.

It is to be noted that in accordance with timing of starting and stopping of the scrolling of the symbol arrays in the symbol display control process or other timing, the presentation determined in the presentation contents determination process (FIG. 10) is executed. For example, a moving image and a still image are displayed on an upper image display panel 1131 of the slot machine 1010, in synchronization therewith, sound is outputted from speakers 1112, and a lamp 1111 is lit up, thereby allowing said presentation to be executed.

<To-be-Paid-Out Number Determination Process>

Figure 14:
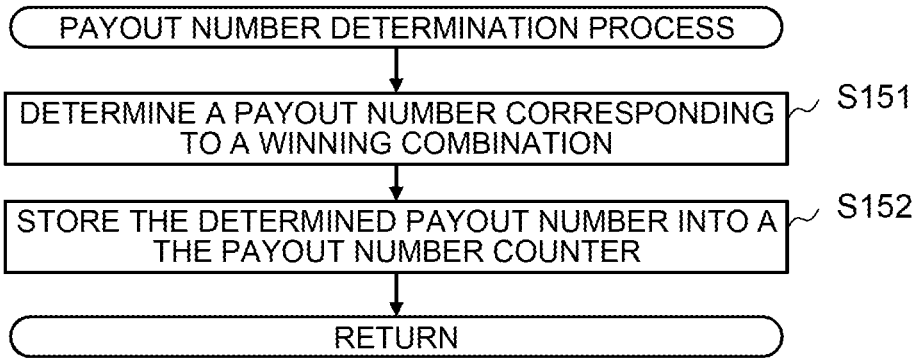
FIG. 14 is a flowchart showing a procedure of a to-be-paid-out number determination process executed on the slot machine according to the one embodiment of the present invention.

Next, with reference to FIG. 14, a to-be-paid-out number determination process will be described. First, a main CPU 1071 determines a to-be-paid-out number corresponding to a winning combination (S151). For example, when the winning combination is a combination of symbols "BELL", the main CPU 1071 determines "8" as the to-be-paid-out number (refer to FIG. 9). It is to be noted that the main CPU 1071 determines "0" as the to-be-paid-out number in a case where a game is lost. Next, the main CPU 1071 stores the determined to-be-paid-out number in a to-be-paid-out number counter (S152). After the process has been conducted, the to-be-paid-out number determination process is completed.

It is to be noted that winning has occurred in a bonus game drawing by a bonus server 11, linkage presentation by PTS terminals 1700 is conducted over a plurality of slot machines 1010 including the slot machine 1010 on which the winning has occurred; in conjunction therewith, a bonus is paid out by a bonus server 11; and the bonus is added to, for example, the to-be-paid-out number counter.

[Configuration of Signage]

Figure 15:
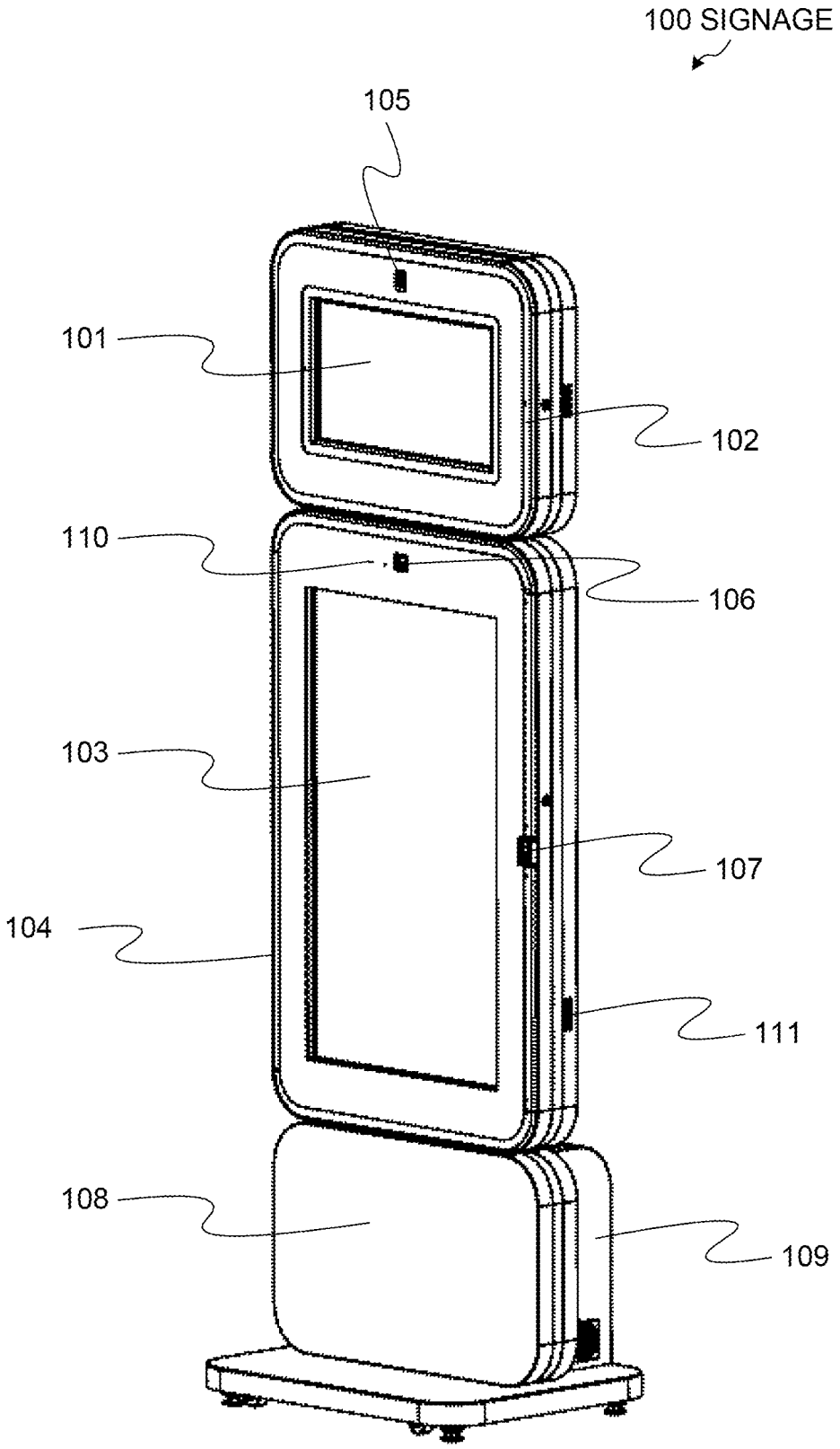
FIG. 15 is a view illustrating an overall structure of a signage according to the one embodiment of the present invention.

FIG. 15 shows a signage 100 which can be used in a game system 1 according to one embodiment of the present invention. The signage 100 is an information display device used to display shop advertisement (including advertisement signboards), a floor guide of a hall, and the like and can be connected to a server (for example, a bonus server 11 or a membership management server 13) of the game system 1 via a network.

The signage 100 includes an LCD 101 and an LCD 103 having a touch panel function. The LCD 101 is, for example, a 24-inch (approximately 60.96 cm) liquid crystal display device and the LCD 103 is, for example, a 46-inch (approximately 116.84 cm) liquid crystal display device, and on these LCDs, as described above, the advertisement information, the guide information, and the like are displayed. In addition, the touch panel function which the LCD 103 has is performed by, for example, a touch panel using an infrared ray system. It is to be noted that although in this example, the LCD 103 is configured to have the touch panel function, the LCD 103 may be configured such that other input devices such as a keyboard and a mouse are used to input instructions thereto.

The LCD 101 and the LCD 103 are housed in respective cabinets, and on peripheral parts of said cabinet front faces, presentation LEDs 102 and 104 for presentation are provided, respectively. The presentation LEDs 102 and 104 are, for example, tape-shaped LED lights.

Further, the signage 100 includes motion sensors 105 and 106 in the cabinet of the LCD 101 and the cabinet of the LCD 103, respectively. The motion sensors 105 and 106 are, for example, cameras, and images shot by the motion sensors 105 and 106 are used to analyze behavior of a user of the signage 100 and customers passing along passages.

The signage 100 also includes a touch unit 107 including an RFID module which is operable to perform data communication with a non-contact IC card, and a mobile phone and a smartphone, each of which has a communication function by NFC. A member holds a membership card (IC card) associated with the member over the touch unit 107, can thereby log therein, and can display a menu screen for a member and information related to the member on the LCD 101 or the LCD 103. The information related to a member is obtained from, for example, a membership management server 13.

In addition, a staff member of a hall holds an IC card of the staff member thereover, can thereby log therein and can display a menu screen for a staff member or the like on the LCD 101 or the LCD 103.

The signage 100 has no card unit for holding an IC card 1500, as compared with a PTS terminal 1700 and only includes the touch unit 107. However, the signage 100 is arranged such that even when after a user has touched with the IC card, the user has left without logging off, the information of a member displayed on the LCD 103 or the like through the touching comes not to be displayed after the elapse of a predetermined time period and the logging off is automatically made.

Further, the signage 100 includes a microphone 133 for obtaining sound into the cabinet of the LCD 103. In the cabinet of the LCD 103, a microphone opening 110 whose position corresponding to a position where the microphone is provided is provided. In FIG. 15, beside the motion sensor 106, this microphone opening 110 is shown.

In addition, the signage 100 includes speakers 134 and 135 for outputting sound into the cabinet of the LCD 103. In the cabinet of the LCD 103, speaker ducts whose positions correspond to positions where the speakers are provided are provided. In FIG. 15, the speaker duct 111 which corresponds to one of the speakers is shown.

In addition thereto, the signage 100 includes a base unit 108 for supporting the cabinet of the LCD 101 and the cabinet of the LCD 103 and a control unit 109 in which a control part for controlling the respective LCDs, LEDs, and the like is housed.

[Configuration of Circuitry of Signage]

Figure 16:
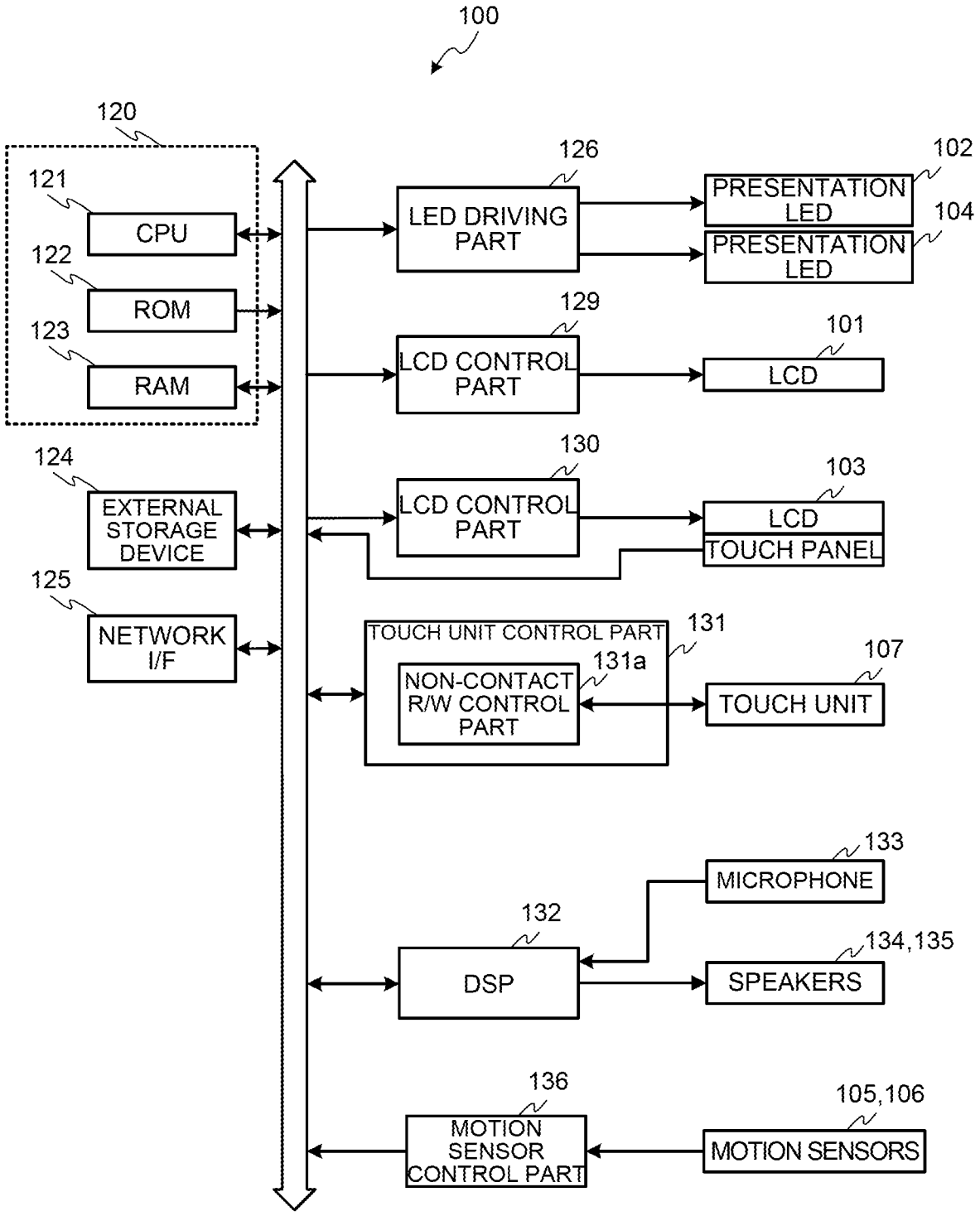
FIG. 16 is a diagram showing a circuitry configuration of the signage according to the one embodiment of the present invention.

Next, with reference to FIG. 16, a configuration of circuitry which the signage 100 includes will be described.

A signage controller 120 which controls the signage 100 has a CPU 121, a ROM 122, and a RAM 123.

The CPU 121 performs execution control of the respective components of the signage, executes various kinds of programs stored in the ROM 122, and performs computation therefor.

The ROM 122 is constituted of a memory device such as a flash memory, and permanent data used for the execution by the CPU 121 is stored therein. For example, a linkage presentation control program and the like executed in response to a request from a bonus server 11 can be stored therein.

The RAM 123 temporarily stores data required upon executing the various kinds of programs stored in the ROM 122.

An external storage device 124 is, for example, a storage device such as a hard dick device and stores programs executed in the CPU 121 and data which the programs executed in the CPU 121 use.

A network I/F (interface) 125 realizes data communication with servers such as the bonus server 11 and a membership management server 13 and a PTS terminal 1700.

An LED driving part 126, in response to a linkage presentation start request from the bonus server 11, controls presentation LEDs 102 and 104 to light up at predetermined timing. In addition, the LED driving part 126 can also cause the presentation LEDs 102 and 104 to emit light in synchronization with display of advertisement information, display of guide information, display of member information based on an operation by a member, and the like.

An LCD control part 129 controls the above-described pieces of information such as the advertisement information to be displayed on an LCD 101.

An LCD control part 130 controls the above-described pieces of information such as the advertisement information to be displayed on an LCD 103. In addition, the LCD 103 includes a touch panel function, with which an operation from a user is transmitted to the CPU 121.

A touch unit control part 131 controls data transmission and reception in association with a touch operation of an IC card or a mobile phone on a touch unit 107. The touch unit control part 131 includes a non-contact R/W (reader/writer) control part 131*a*.

The non-contact R/W control part 131*a* determines whether or not there has been the touch operation of an IC card or a mobile phone on the touch unit 107 and when there has been the touch operation, obtains a read result or the like from the touch unit 107. The touch unit 107 has an antenna part for performing data transmission and reception with an IC card or a mobile phone through NFC or the like.

When the CPU 121 has obtained an identification code of a membership card (IC card) from the touch unit 107, the CPU 121 obtains information of a member associated with the identification code from a membership management server 13 and displays the information on the LCD 101 and the LCD 103. In addition, the CPU 121 can also cause an operation menu for the member to be displayed on the LCD 103 and cause advertisement information suited for the member to be displayed on the LCD 101 and the LCD 103.

A DSP 132 receives sound data obtained from a microphone 133, subjects the received sound data to predetermined processing, and thereafter, transmits the processed data to the CPU 121. In addition, in order to output the received sound data, the DSP 132 transmits this data to speakers 134 and 135.

A motion sensor control part 136 obtains images of a user and the like received from motion sensors (for example, cameras) 105 and 106, subjects the images to predetermined image processing as needed, and transmits the processed data to the CPU 121.

[Configuration of Kiosk Terminal]

Figure 17:
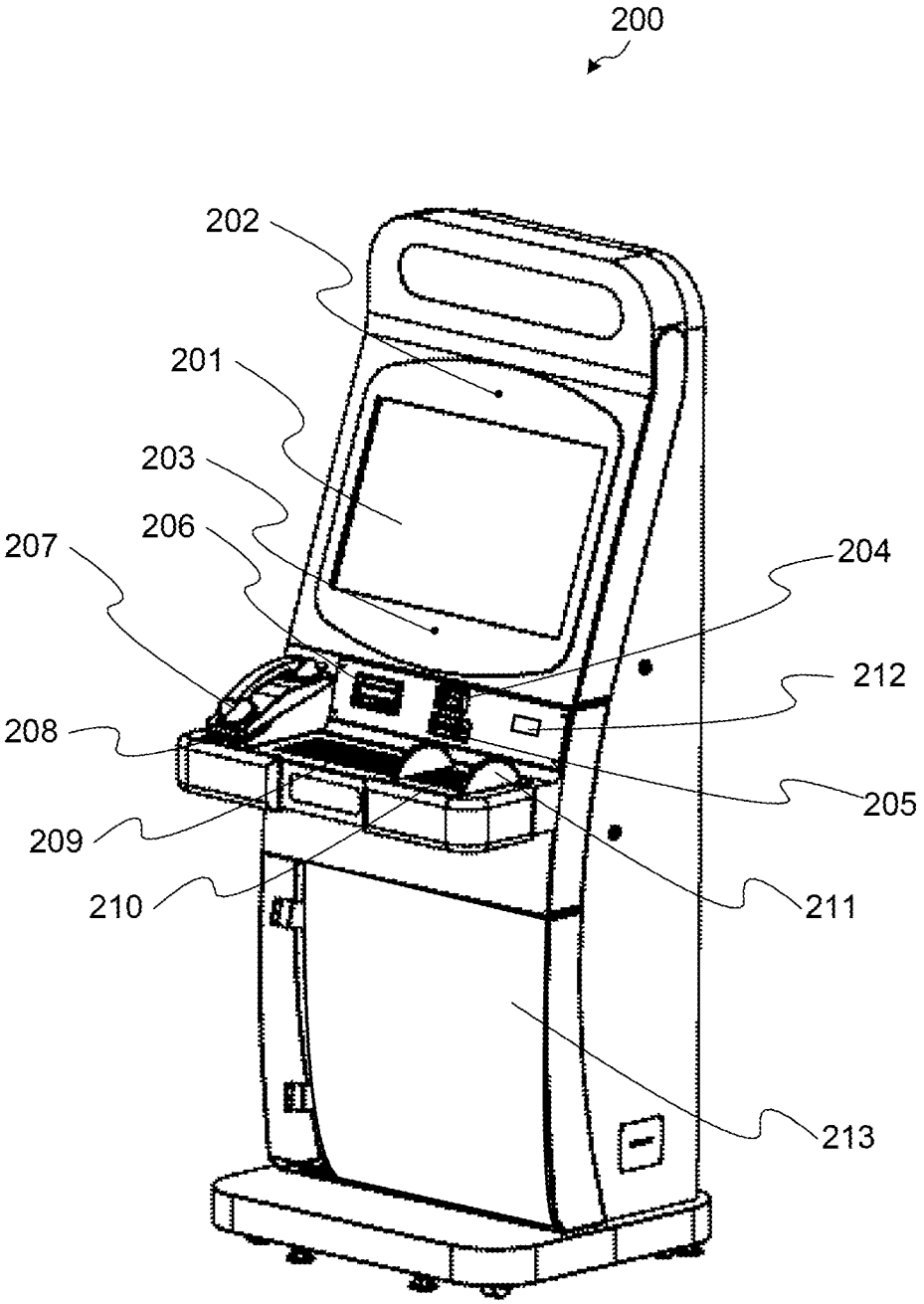
FIG. 17 is a view illustrating an overall structure of a kiosk terminal according to the one embodiment of the present invention.

FIG. 17 shows a kiosk (KIOSK) terminal 200 which can be used in a game system 1 according to one embodiment of the present invention. The kiosk terminal 200 is an information display device used to display information pertinent to games conducted in a hall, for example, information pertinent to the start of a bonus game conducted on a bonus server 11, a countdown upon said start, today's winning ranking, popular machine ranking, and the like and is connected via a network to servers (for example, the bonus server 11 and a membership management server 13) of the game system 1.

The kiosk terminal 200 includes an LCD 201 having a touch panel function. The LCD 201 is, for example, a 24-inch (approximately 60.96 cm) liquid crystal display device, and as mentioned above, the information pertinent to the games conducted in a hall and the like are displayed on this LCD. It is to be noted that although in this example, the LCD 201 is configured to have the touch panel function, instructions may be inputted by using other input devices such as a keyboard and a mouse.

Further, the kiosk terminal 200 includes motion sensors 202 and 203 above and below the LCD 201, respectively. The motion sensors 202 and 203 are, for example, cameras, and images shot by the motion sensors 202 and 203 are used to analyze behavior of a user of the kiosk terminal 200 and customers passing along passages.

In addition, the kiosk terminal 200 includes a touch unit 204 including an RFID module which is operable to perform data communication with a non-contact IC card, and a mobile phone and a smartphone, each of which has a communication function by NFC. A member holds a membership card (IC card) associated with the member over the touch unit 204, can thereby log therein, and can display a menu screen for a member and information related to the member on the LCD 201. The information related to a member is obtained from, for example, the membership management server 13. In addition, besides the touch unit 204 or instead of the touch unit 204, the kiosk terminal 200 may include an information recording medium reading device for reading information stored in an information recording medium such as a magnetic card. In this case, instead of the IC card 1500, the magnetic card can be used as a membership card.

In addition, a staff member of a hall holds an IC card of the staff member thereover, can thereby log therein, and can display a menu screen for a staff member or the like on the LCD 201.

Further, the kiosk terminal 200 is provided with a card insertion slot 205 to and from which an IC card 1500 can be inserted and ejected. The card insertion slot 205 is provided with an eject button. In addition, in an inside of a kiosk housing, whose position corresponds to a position of the card insertion slot 205, a card unit 230 is provided. The card insertion slot 205 is configured as one part of the card unit 230.

When a membership card is inserted from the card insertion slot 205, a menu screen for a member and information related to the member can be displayed on the LCD 201. In addition, the card unit 230 is operable to issue and collect a limited card and a rewards card.

In addition, the kiosk terminal 200 includes a ticket printer 206. The ticket printer 206 is operable to issue and collect a ticket and a coupon and can also be configured to have a function as a bill validator.

Further, the kiosk terminal 200 includes a phone receiver 207 used in a phone call by VoIP. Via the phone receiver 207, a user of the kiosk terminal 200 can have conversation with a user of other kiosk terminal 200 or a player of a gaming machine. In addition, an incoming LED 208 is controlled to emit light upon incoming of a phone call by the VoIP.

In addition, the kiosk terminal 200 includes a keyboard 209 and a numeric keypad 210 used when a user inputs data (in member registration and text chatting) and further, is provided with LED plates 211 for peep prevention on both sides of the numeric keypad 210.

Further, the kiosk terminal 200 is provided with a QR code scanner 212 for reading a QR code (registered trademark), which is caused to read a QR code attached to an email addressed to a mobile phone or the like.

In addition thereto, the kiosk terminal 200 includes a storage part 213 having stored therein control parts for controlling the LCD, the LED, and the like.

[Configuration of Circuitry of Kiosk Terminal]

Figure 18:
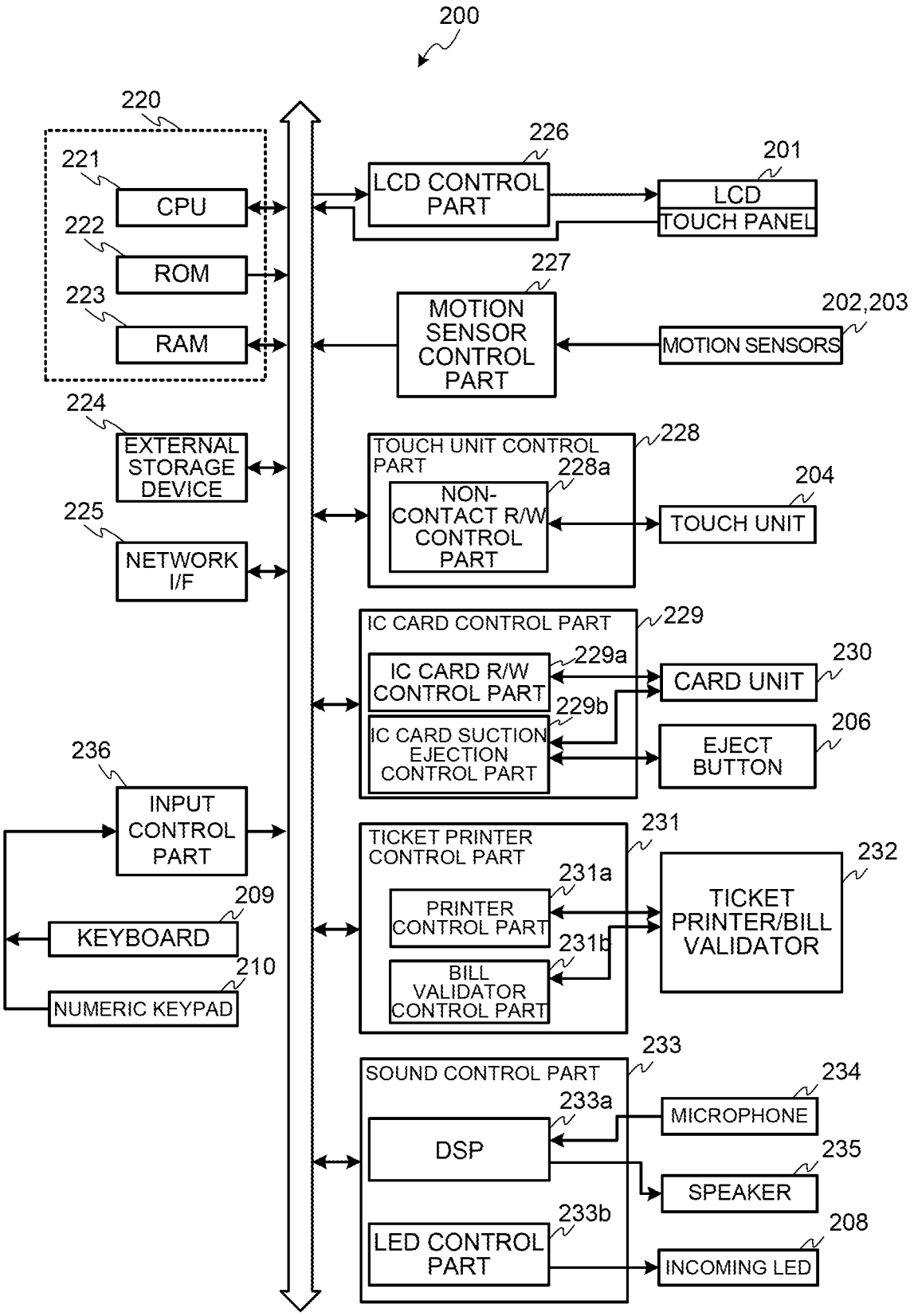
FIG. 18 is a diagram showing a circuitry configuration of the kiosk terminal according to the one embodiment of the present invention.

Next, with reference to FIG. 18, a configuration of circuitry which a kiosk terminal 200 includes will be described.

A kiosk terminal controller 220 which controls the kiosk terminal 200 has a CPU 221, a ROM 222, and a RAM 223.

The CPU 221 performs execution control of the respective components of the signage, executes various kinds of programs stored in the ROM 222, and performs computation therefor.

The ROM 222 is constituted of a memory device such as a flash memory, and permanent data used for the execution by the CPU 221 is stored therein. For example, a communication control program by the VoIP and the like can be stored therein.

The RAM 223 temporarily stores data required upon executing the various kinds of programs stored in the ROM 222.

An external storage device 224 is, for example, a storage device such as a hard dick device and stores programs executed in the CPU 221 and data which the programs executed in the CPU 221 use.

A network I/F (interface) 225 realizes data communication with servers such as a bonus server 11 and a membership management server 13 and a PTS terminal 1700.

An LCD control part 226 controls displaying of the above-mentioned information such as the game information on the LCD 201. In addition, the LCD 201 includes a touch panel function, and an operation from a user is transmitted to the CPU 221.

A motion sensor control part 227 obtains images of a user and the like received from motion sensors (for example, cameras) 202 and 203, subjects the images to predetermined image processing, and transmits the processed data to the CPU 221.

A touch unit control part 228 controls data transmission and reception in association with a touch operation of an IC card or a mobile phone on a touch unit 204. The touch unit control part 228 includes a non-contact R/W (reader/writer) control part 228*a*.

The non-contact R/W control part 228*a* determines whether or not there has been the touch operation of an IC card or a mobile phone on the touch unit 204 and when there has been the touch operation, obtains a read result or the like from the touch unit 204. The touch unit 204 has an antenna part for performing data transmission and reception with an IC card or a mobile phone through NFC or the like.

In addition, an IC card control part 229 controls insertion and ejection of an IC card 1500, reading of data, and the like. The IC card control part 229 includes an IC card R/W (reader/writer) control part 229*a* and an IC card suction ejection control part 229*b*.

The IC card R/W control part 229*a* controls a card unit 230 to read an identification code or the like stored in an IC card 1500. The card unit 230 has an antenna part for writing data by NFC or the like into an IC card 1500.

The IC card suction ejection control part 229*b* controls suction and ejection of an IC card 1500. When an IC card 1500 is inserted into a card insertion slot 205 by a user, the IC card suction ejection control part 229*b* controls holding of the IC card in the card unit 230 until the user logs off. In addition, when an eject button is pressed, the IC card suction ejection control part 229*b* ejects the IC card 1500.

A ticket printer control part 231 controls a ticket printer/bill validator 232, for example, to issue and collect a ticket and a coupon and identifies a bill. The ticket printer control part 231 has a printer control part 231*a* and a bill validator control part 231*b*.

A sound control part 233 outputs and inputs sound by using a speaker 235 and a microphone 234 included in a phone receiver 207. The sound control part 233 includes a DSP 233*a* and an LED control part 233*b*. The DSP 233*a* performs predetermined sound signal processing for sound inputted from the microphone 234 and sound outputted from the speaker 235, thereby performing the control. The LED control part 233*b* controls an incoming LED 208 to emit light based on an incoming signal by a phone call by VoIP or the like.

An input control part 236 converts input on an keyboard 209 and input on a numeric keypad 210 from a user to signals and transmits the signals to the CPU 221.

[Friend Registration Service]

Next, with reference to FIG. 19 and FIG. 20, a friend registration service executed on a slot machine 1010 (PTS terminal 1700) will be described. Although the friend registration service on the PTS terminal 1700 is described here, the same service is provided also on a kiosk terminal 200.

Figure 19A:
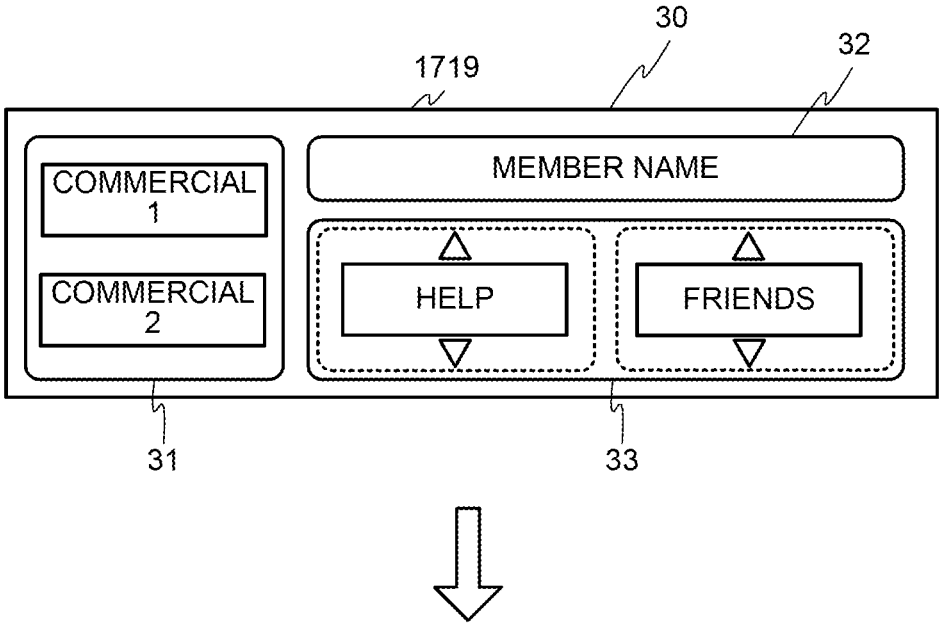
FIGS. 19A and 19B are diagrams illustrating an example of a display screen related to friend registration service on a display device of the PTS terminal according to the one embodiment of the present invention.

FIG. 19A shows a menu screen 30 for a member displayed on an LCD 1719 of the PTS terminal 1700 after a player has inserted a membership card into a card insertion slot 1730 of the PTS terminal 1700 and has logged in as a member.

In the menu screen 30 shown in FIG. 19A, an advertisement display part 31, a member name display part 32, and a service menu display part 33 are displayed. In this example, in the service menu display part 33, two service menus are concurrently displayed by two scroll displays. In the scroll display on a left side, a button of "HELP" service (help display service for displaying operation methods and the like of the PTS terminal 1700 and the slot machine 1010) is displayed, and in the scroll display on a right side, a button of "FRIENDS" service is displayed. In each of the scroll displays, an upper triangular display or a lower triangular display is touched, thereby displaying a button of other service menu.

Figure 19B:
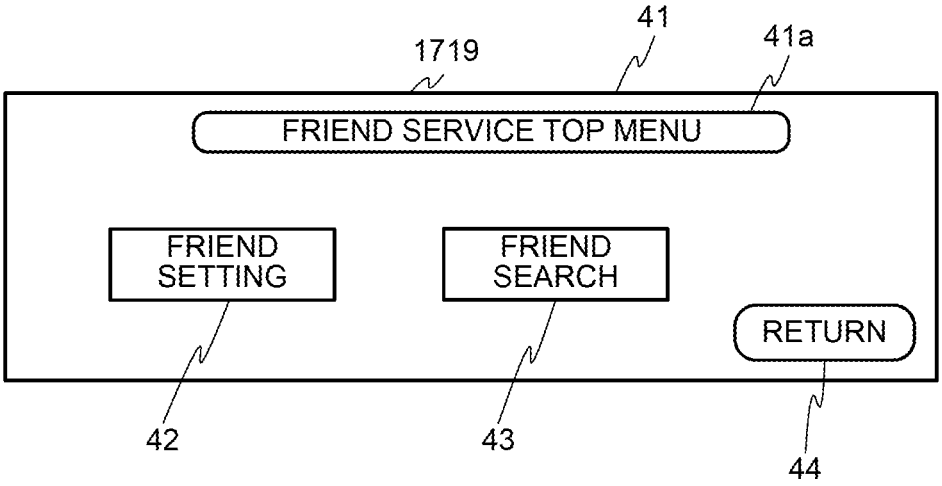

Here, when a player touches the button of the "FRIENDS" service, the display on the LCD 1719 is shifted to a screen shown in FIG. 19B.

FIG. 19B shows a top menu 41 for the friend service, and a title display part 41*a*, a friend setting button display part 42, a friend search button display part 43, and a "return" button display part 44 are displayed therein. When a player touches one of the friend setting button display part 42 and the friend search button display part 43, a lower level screen corresponding thereto is displayed. In addition, when a player touches the "return" button display part 44, a CPU 1751 detects a position of the touch operation and shifts the display in the LCD 1719 to the menu screen 30 shown in FIG. 19A.

The above-mentioned respective service menus and a provision system of said service are realized, for example, such that HTML data, images, and the like are interpreted and displayed by a Web browser executed on the PTS terminal 1700. In this case, a hall management server 10 or the like functions as a WEB server and in response to a request by the Web browser of the PTS terminal 1700, transmits necessary data to the PTS terminal 1700.

Figure 20A:
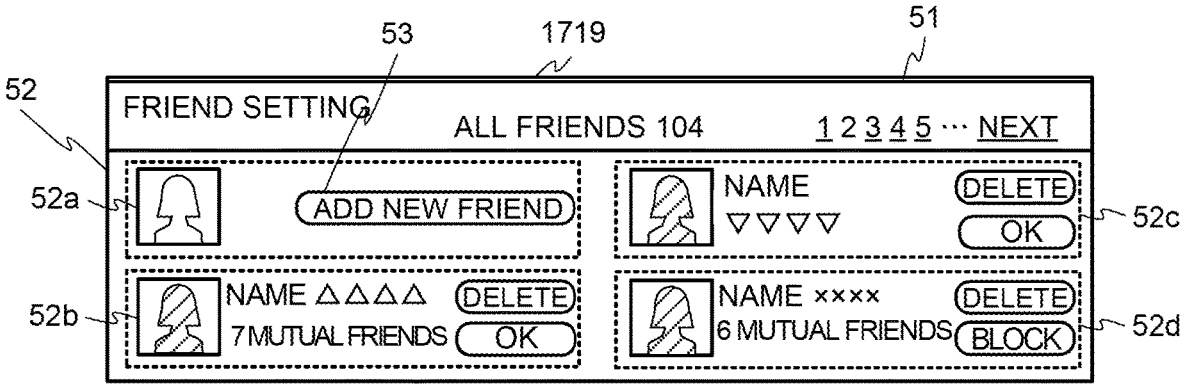
FIGS. 20A to 20C are diagrams illustrating the example of the display screen related to the friend registration service on the display device of the PTS terminal according to the one embodiment of the present invention.

FIG. 20A shows a friend setting screen 51 displayed on the LCD 1719 when the friend setting button display part 42 in the top menu 41 for the friend service shown in FIG. 19B is touched. In this friend setting screen 51, friends registered in association with a member (a member identified by a membership card) who has logged in are list-displayed in a friend display part 52. Up to four friends can be displayed at one time as shown in FIG. 20A, and for example, by touching a page display part displayed on a right side of the title display part or by flicking a touch panel, other friends can be further displayed.

Data related to the friends displayed in the friend setting screen 51 shown in FIG. 20A is obtained, for example, by referencing friend identification codes corresponding identification codes of members, who have currently logged in, in a friend management table (stored on a membership management server 13) shown in FIG. 21B, by referencing a membership management table (stored on the membership management server 13) shown in FIG. 21A with respect to the respective friend identification codes, and by referencing records of the identification codes corresponding to the friend identification codes.

For example, when an identification code of a member who has logged in is read from a membership card and the identification code is "0001", it is found by referencing the friend management table shown in FIG. 21B that "0002", "0003", "0005", and "0007" are included as identification codes of friends in association with "0001". With respect to each of these identification codes, by referencing the membership management table shown in FIG. 21A, corresponding information (for example, a name, icon data, and the like) is obtained. In this example, a name of a member whose identification code is "0002" is "ΔΔΔΔ" and icon data is ..¥image0002.jpg.

In FIG. 20A, the name and an icon of the member identified by the identification code "0002" are shown in a friend detail display part 52*b*; a name and an icon of a member identified by the identification code "0003" are shown in a friend detail display part 52*c*; and a name and an icon of a member identified by the identification code "0005" are shown in a friend detail display part 52*d*. In addition, a "DELETE" button display part displayed in each of the friend detail display parts is touched, thereby allowing the friend to be deleted from setting.

It is to be noted that with respect to the friend whose identification code is "0005", a status is set to be "BLOCK" in the friend management table shown in FIG. 21B, and also in the friend detail display part 52*d*, reflecting this setting, "BLOCK" is displayed in a status display part. When the status is set to be "BLOCK" as mentioned above, that friend is set to be out of a target related to a request for a VoIP phone call, text chatting, or the like. When in each of the friend detail display part 52*b* and the friend detail display part 52*c*, "OK" is displayed in the status display part, the VoIP phone call, the text chatting, or the like with that friend is enabled.

In addition, in the friend detail display part 52*a* shown in FIG. 20A, a new registration button display part 53 for newly registering a friend is displayed, and by touching the new registration button display part 53, a new friend can be registered.

Figure 20B:
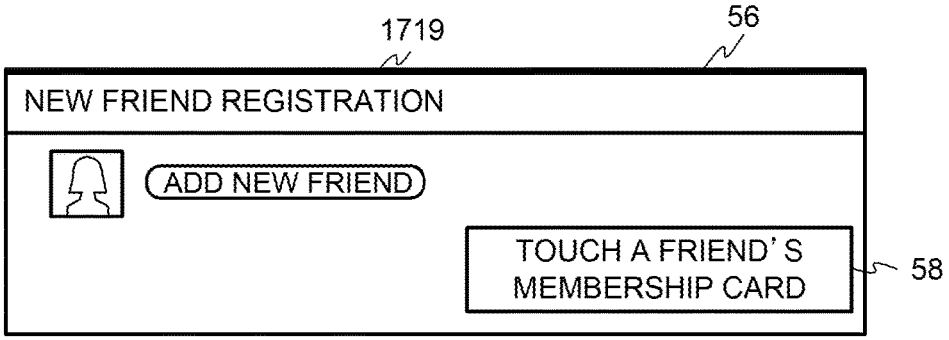

When the new registration button display part 53 in the friend detail display part 52*a* is touched, a new registration screen 56 shown in FIG. 20B is displayed in the LCD 1719. Here, in accordance with a guide display 58 for guiding a friend to touch a membership card of the friend to be registered on a touch unit 1745 of the PTS terminal 1700, a player who has logged in as a member conducts the registration by touching the membership card of the friend to be registered onto the touch unit 1745. This touch operation is normally conducted by the friend to be registered under the agreement of the friend.

Figure 20C:
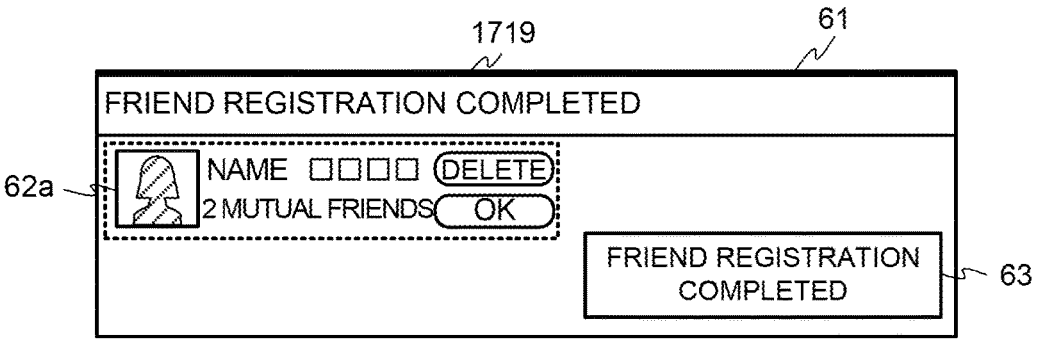

Upon completing this touch operation, as shown in FIG. 20C, a friend registration completion screen 61 is displayed in the LCD 1719. In the friend registration completion screen 61, a friend registration end guide display 63 indicating that the friend registration has been completed is displayed, and a friend detail display part 62*a* of the friend who has been newly registered at this time is displayed.

Through the above-described friend registration, the CPU 1751 of the PTS terminal 1700 adds the record of the friend registered at this time to the friend management table shown in FIG. 21B. Upon adding the record, the identification code read from the membership card with which the touch unit 1745 has been touched matches the any of the identification codes registered in the membership management table shown in FIG. 21A. In other words, it is checked whether the friend is an authentic member, and if the friend is not the authentic member, error display is conducted, ending in failure of the registration.

The above-described friend registration service can be executed also on the kiosk terminal 200 as mentioned above. In this case, since an LCD 201 is of a size larger than that of the LCD 1719 of the PTS terminal 1700, more friends can be list-displayed in larger sizes. In addition, a touch unit 204 is touched with a membership card of a friend, thereby allowing an identification code of the membership card to be obtained.

[VoIP Phone Call Service]

Next, with reference to FIG. 22 to FIG. 25, VoIP phone call service which can be realized between slot machines 1010 (PTS terminals 1700); between a slot machine 1010 and a kiosk terminal 200; or between kiosk terminals 200 will be described.

Figure 22:
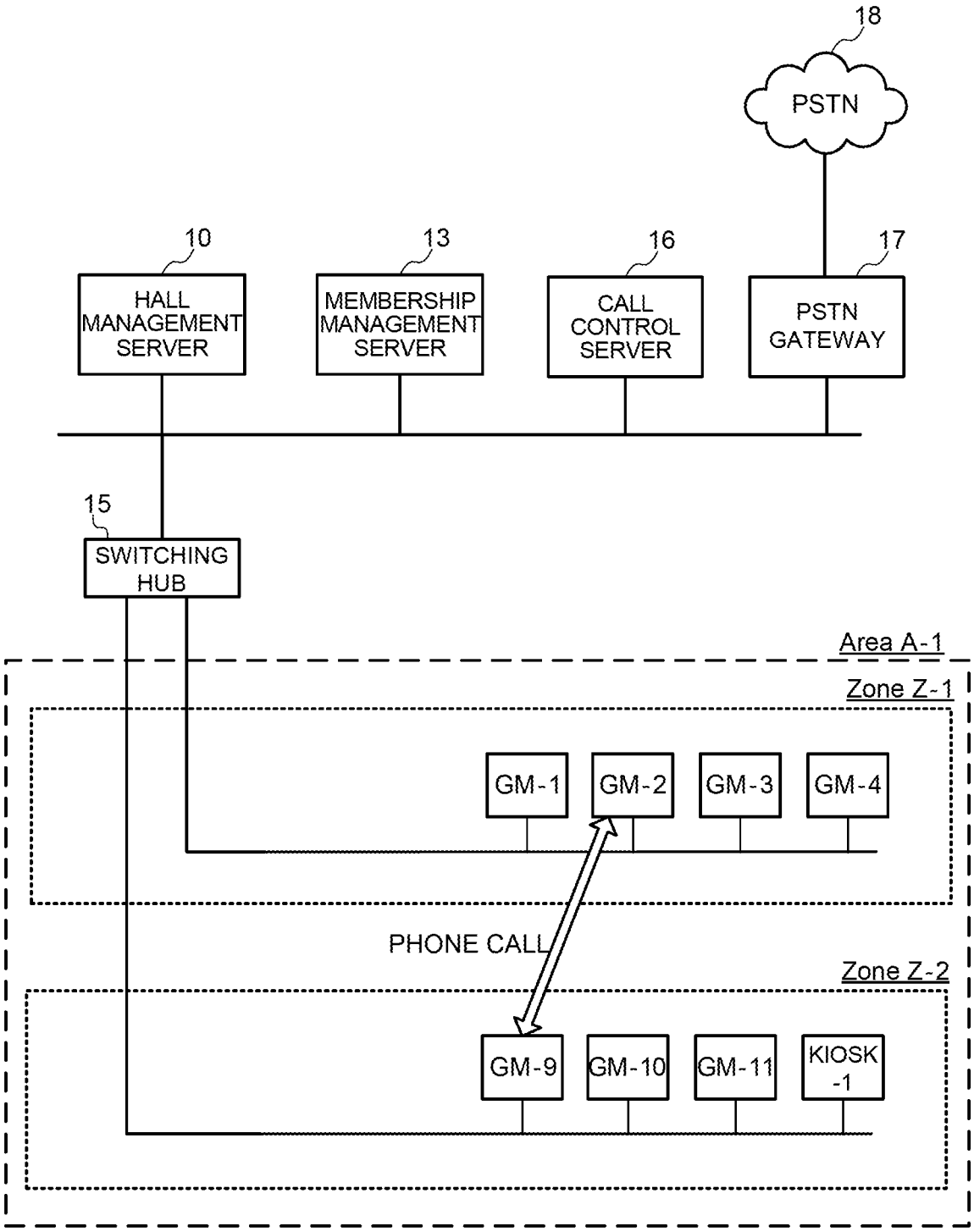
FIG. 22 is a diagram illustrating an outline of a network configuration of the game system according to the one embodiment of the present invention.

FIG. 22 is a diagram illustrating a network configuration of a game system in the VoIP phone call service. In an example shown in FIG. 22, in an area A-1 of a hall, there are two zones Z-1 and Z-2, and in the zone Z-1, four gaming machines (GM-1 to GM-4) are connected by a network such as Ethernet via a LAN connection and in the zone Z-2, three gaming machines (GM-9 to GM-11) and one kiosk terminal (KIOSK-1) are connected by the network such as the Ethernet via the LAN connection. It is to be noted that each of the gaming machines is a slot machine 1010 here.

In addition, a hall management server 10, a membership management server 13, a call control server 16, and a PSTN gateway 17 are connected via the network such as the Ethernet to the respective apparatuses in the above-mentioned two zones via a switching hub 15. It is to be noted that other necessary network connection devices such as a router and a hub are not shown.

Here, the call control server 16 is a server for controlling a VoIP phone call. The PSTN gateway 17 is an apparatus for controlling connection with a PSTN (Public Switched Telephone Network) 18 to realize a phone call between an apparatus in the hall and a telephone outside the hall.

Here, the description is made, for example, by taking as an example a VoIP phone call from a member with an identification code "0001" to a member with an identification code "0007" (substantially, a VoIP phone call between the gaming machine GM-2 and the gaming machine GM-9).

Figure 23:
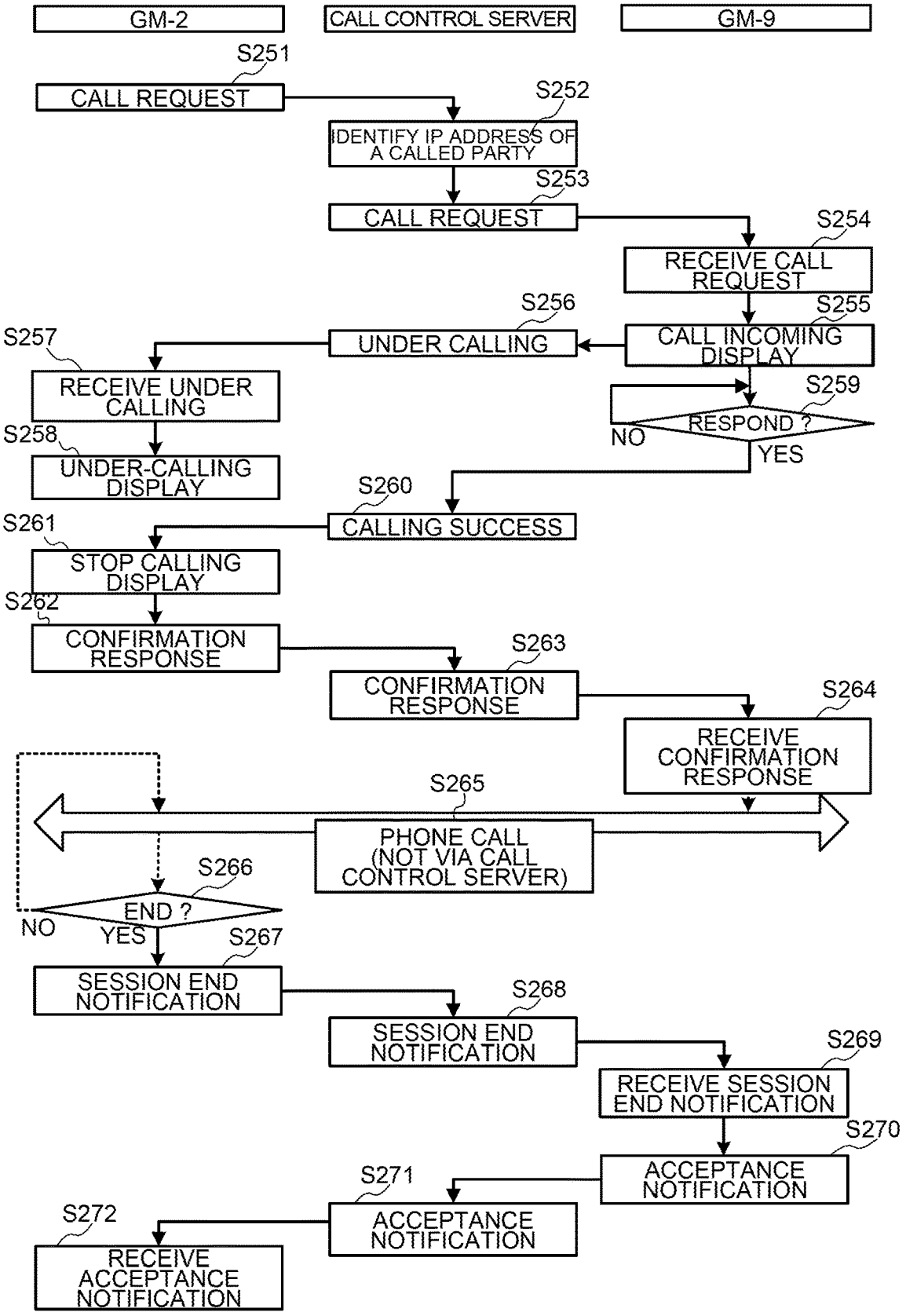
FIG. 23 is a flowchart showing a procedure of a call control process of a VoIP phone call using the PTS terminal according to the one embodiment of the present invention.

FIG. 23 shows a control procedure for realizing the VoIP phone call between the gaming machine GM-2 and the gaming machine GM-9. In FIG. 23, processing contents for each of the gaming machine GM-2, the call control server 16, and the gaming machine GM-9 are shown. For the VoIP phone call, for example, a variety of protocols such as SIP (Session Initiation Protocol) and H.323 are available, and here, the description is made by taking a processing procedure by the SIP as an example. It is to be noted that in a case where the SIP is used, the call control server is referred to as an SIP server.

Prior to the description with reference to FIG. 23, a registration process conducted separately from VoIP phone call control will be described. Each of the gaming machines transmits its own URI or phone number with an IP address being associated therewith to the call control server 16 as needed. Here, for the sake of convenience, an identification code obtained from a membership card is used as a substitute corresponding to the URI or the phone number. Accordingly, the call control server 16 has an address management table shown in FIG. 21C and is capable of grasping a gaming machine (a PTS terminal 1700 of a slot machine 1010) having which IP address is used by a member having which identification code in real time. Of course, when a player changes a slot machine 1010, in response thereto, contents of the address management table also change. It is to be noted that gaming machine identifiers stored in the address management table are merely added to facilitate the description and are not necessary in the actual call control process.

In a flow shown in FIG. 23, first, when the member with the identification code "0001" sends the VoIP phone call from the gaming machine GM-2 on which the member is playing a game to the member with the identification code "0007" who has been registered as a friend, a call request (INVITE) is transmitted from the gaming machine GM-2 to the call control server 16 (S251). At this time, the call request from the gaming machine GM-2 includes the identification code "0007" of the called party of the phone call.

At this time, the member with the identification code "0001" on a calling side is not required to be conscious of which slot machine 1010 is used by the called party on a called side and which IP address is used by that slot machine 1010. However, as described later, the member on the calling side can grasp who, among the friends, are using the slot machines 1010, playing games and are in a state in which the VoIP phone call can be responded.

Next, when the call control server 16 has received this call request, an IP address of the slot machine 1010 used by the member with the identification code "0007" who is the called party of the phone call is identified (S252). In this process, based on the identification code included in the call request, by referencing the address management table shown in FIG. 21C, the IP address is identified. In this example, it is found by referencing the address management table that the IP address of the slot machine 1010 used by the member with the identification code "0007" who is the called party of the phone call is "192.168.52.48".

Next, the call control server 16 transmits a call request to the slot machine 1010 with the identified IP address (that is, at this point in time, the gaming machine GM-9) (S253). When the gaming machine GM-9 has received this call request (S254), in an LCD 1719 of the PTS terminal 1700 of the gaming machine GM-9, incoming display which notifies the incoming of the VoIP phone call is conducted (S255). In addition to the above-mentioned incoming display, it is also made possible to output incoming sound from speakers 1707 and 1709 of the PTS terminal 1700.

Thereafter, when the call control server 16 has received an under-calling signal from the gaming machine GM-9, the call control server 16 transmits this under-calling signal to the gaming machine GM-2 (S256). When the gaming machine GM-2 has received this under-calling signal (S257), in an LCD 1719 of the PTS terminal 1700 of the gaming machine GM-2, under-calling display indicating that calling is being made is conducted (S258).

On the gaming machine GM-9, until the incoming is responded, the incoming display is continuously conducted (NO at S259). The response to the incoming is conducted, for example, such that a player of the gaming machine GM-9 touches a response button display part of the incoming display displayed in the LCD 1719. When the incoming is responded on the gaming machine GM-9 (YES at S259), the call control server 16 transmits a calling success signal (OK) to the gaming machine GM-2 (S260).

When the gaming machine GM-2 has received this calling success signal, the gaming machine GM-2 stops the calling display (S261) and transmits an acknowledgment signal (ACK) (S262). When the call control server 16 has received this acknowledgment signal, the call control server 16 further transmits this acknowledgment signal to the gaming machine GM-9 (S263).

When the gaming machine GM-9 has received the acknowledgment signal (S264), here, a session between the gaming machine GM-2 and the gaming machine GM-9 is established, enabling the phone call therebetween (NO at S265 and S266). Since in this phone call, the gaming machine GM-2 and the gaming machine GM-9 are directly connected, the call control server does not intervene.

When the phone call has been ended (here, the gaming machine GM-2 ends the phone call) (YES at S266), the gaming machine GM-2 transmits session end notification (BYE) to the call control server 16 (S267). Further, the call control server 16 transmits this session end notification to the gaming machine GM-9 (S268). When the gaming machine GM-9 has received this session end notification (S269), the gaming machine GM-9 transmits okay notification (OK) to the call control server 16 (S270). When the call control server 16 has received this okay notification, the call control server 16 transmits the okay notification to the gaming machine GM-2 (S271). The gaming machine GM-2 receives this okay notification (S272), and the series of operations of the session is ended, thereby disconnecting the phone call.

The above-described VoIP call control procedure is merely one example, and in accordance with an adopted protocol, the call control processing is conducted through a variety of procedures. In addition, although in this example, the phone call is made between the gaming machines (slot machines 1010), as mentioned above, the phone call can also be made between the slot machine 1010 and the kiosk terminal 200 or between the kiosk terminals 200.

On the slot machine 1010, voice of a player on the gaming machine GM-9 on the called side is provided by headphones or the like which are connected to the speakers 1707 and 1709 or an audio terminal 1738, and voice of a player on the gaming machine GM-2 on the calling side is provided for the called party by microphones which are connected to microphones 1715 and 1717 or the audio terminal 1738.

In addition, on the kiosk terminal 200, by using a microphone 234 and a speaker 235 included in a phone receiver 207, voice is inputted and outputted. Voice of a user on the called side is provided from the speaker 235, and voice of a user on the calling side is provided for the called party via the microphone 234.

Figure 24A:
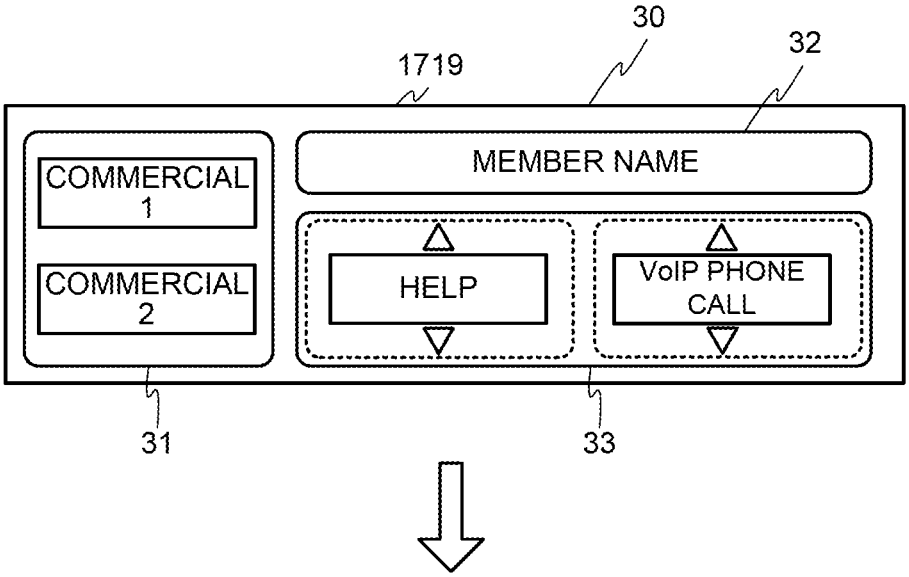
FIGS. 24A and 24B are diagrams illustrating an example of a display screen related to a calling operation for the VoIP phone call on the display device of the PTS terminal according to the one embodiment of the present invention.

Next, with reference to FIG. 24 and FIG. 25, a calling operation for the VoIP phone call will be described. FIG. 24A shows a menu screen 30 for a member displayed on the LCD 1719 of the PTS terminal 1700 after a player has inserted a membership card into a card insertion slot 1730 of the PTS terminal 1700 of the slot machine 1010 and has logged in as a member.

In the menu screen 30 shown in FIG. 24A, an advertisement display part 31, a member name display part 32, and a service menu display part 33 are displayed. In this example, in the service menu display part 33, two service menus are concurrently displayed by two scroll displays. In the scroll display on a left side, a button of "HELP" service (help display service for displaying operation methods and the like of the PTS terminal 1700 and the slot machine 1010) is displayed, and in the scroll display on a right side, a button of "VoIP phone call" service which allows the VoIP phone call between members to be made is displayed. In each of the scroll displays, an upper triangular display or a lower triangular display is touched, thereby displaying a button of other service menu.

Figure 24B:
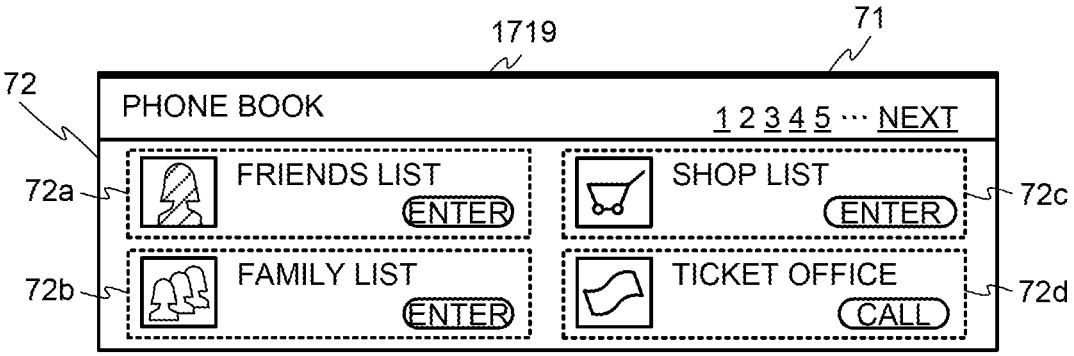

Here, when a player touches the button of the "VoIP phone call" service, a display in the LCD 1719 is shifted to a phone book screen 71 shown in FIG. 24B. In the phone book screen 71, targets to which the member (a member identified by a membership card) who has logged in can make a phone call by the VoIP phone call are list-displayed. Up to four targets can be displayed at one time in a phone book display part 72 as shown in FIG. 24B, and for example, by touching a page display part displayed on a right side of a title display part or by flicking a touch panel, other call destinations can be further displayed.

In FIG. 24B, in a phone book detail display part 72*a* of the phone book display part 72, a link display part of a friends list (an "ENTER" button display part) is displayed; in a phone book detail display part 72*b* thereof, a link display part of a family list (an "ENTER" button display part) is displayed; in a phone book detail display part 72*c* thereof, a link display part of a shop list (an "ENTER" button display part) is displayed; and in a phone book detail display part 72*d* thereof, a call instruction part of a ticket office (a "CALL" button display part) is displayed. As described above, in the phone book display part 72, the link display parts (the "ENTER" button display parts), each of which develops and displays the list, and the call instruction part (the CALL" button display part) can be displayed in a mixed manner.

Figure 25A:
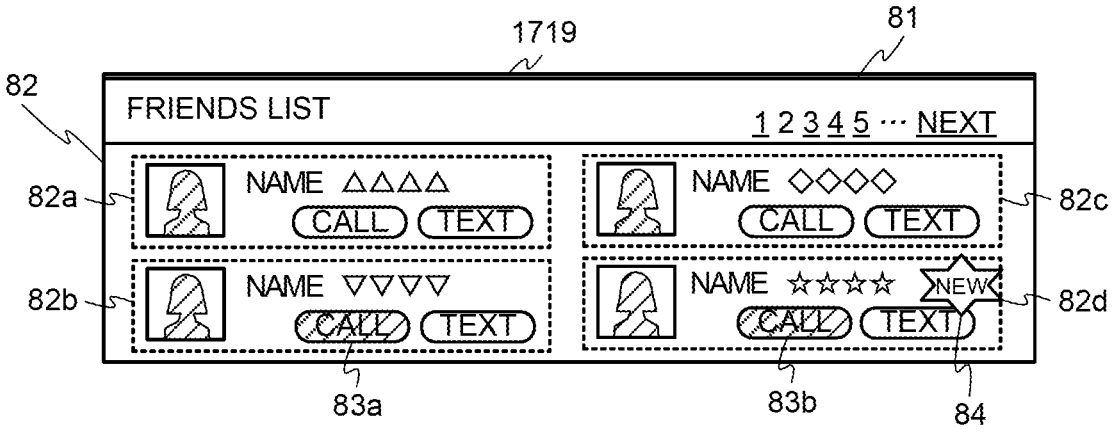
FIGS. 25A and 25B are diagrams illustrating an example of the display screen related to the calling operation for the VoIP phone call on the display device of the PTS terminal according to the one embodiment of the present invention.

Here, when the link display part of the friends list in the phone book detail display part 72*a* is touched, the LCD 1719 of the PTS terminal 1700 is shifted to a friends list display screen 81 shown in FIG. 25A. Here, a list of friends who have been registered by the member who has logged in (refer to FIG. 19 to FIG. 21) is displayed. A friends list of a player with the identification code "0001" is displayed herein.

In the friends list display screen 81, up to four friends can be displayed at one time in the call destination display part 82 as shown in FIG. 25A, and for example, by touching a page display part displayed on a right side of a title display part or by flicking a touch panel, other call destinations can be further displayed.

In this example, in each of respective call destination detail display parts (82*a* to 82*d*), a call instruction part (a "CALL" button display part) and a "TEXT" button display part are displayed. By touching the "CALL" button display part, the VoIP phone call to a corresponding member is made, and this corresponds to the call request (INVITE) described with reference to FIG. 23. In addition, a "CALL" button display part 83*a* of the call destination detail display part 82*b* and a "CALL" button display part 83*b* of the call destination detail display part 82*d* are displayed in a grayed-out manner and do not allow touch operations. This shows that although those friends have been registered by a player on this slot machine 1010, because at this point in time, those friends are neither using the slot machines 1010 (those friends have not logged in by membership cards) nor have logged in to kiosk terminals 200, each of those friends cannot respond to the VoIP phone call.

Here, in the call destination display part 82, the friends registered by the member with the identification code "0001" are displayed (refer to FIG. 21A and FIG. 21B). In the call destination detail display part 82*a*, information pertinent to a member with an identification code "0002" is displayed; in the call destination detail display part 82*b*, information pertinent to a member with an identification code "0003" is displayed; in the call destination detail display part 82*c*, information pertinent to the member with the identification code "0007" is displayed; and in the call destination detail display part 82*d*, information pertinent to a member with an identification code "0009" is displayed. In addition, although a member with an identification code "0005" is registered in the friends list, because a status of this member is set to be "BLOCK", this member is not displayed in the call destination display part 82.

By touching the "TEXT" button display part, a text message can be communicated to a corresponding member. In the call destination detail display part 82*d*, at an upper right-hand side of the "TEXT" button display part, a "NEW" display 84 is displayed, which indicates that a text message is transmitted from that member. A player touches this "TEXT button display part, thereby allowing the text message transmitted from that member to be displayed on the LCD 1719 of the PTS terminal 1700.

Figure 25B:
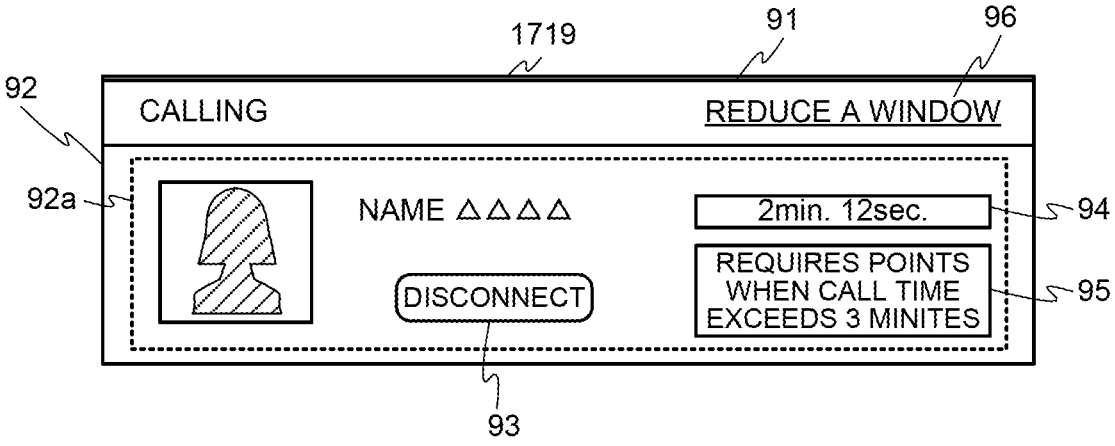

Here, when the "CALL" button display part in the call destination detail display part 82*a* is touched, the VoIP phone call to the corresponding member (the member with the identification code "0002") is made, and an under-calling screen 91 shown in FIG. 25B is displayed in the LCD 1791 of the PTS terminal 1700. In a call destination display part 92, a name and an icon of the member of the called party displayed in the call destination detail display part 82*a* shown in FIG. 25A are displayed, and further, a "disconnection" button display part 93, a phone call elapsed time display part 94, and a point consumption notice 95 are displayed.

When the "disconnection" button display part 93 is touched, the VoIP phone call is disconnected. In the phone call elapsed time display part 94, an elapsed time of the current phone call is displayed.

In addition, in the point consumption notice 95, displayed is a notice informing that when a calling time exceeds a predetermined period of time (in this example, three minutes), the charge for the phone call is required and the charge is collected from points provided for the member. As described above, it is also made possible to collect the charge for the phone call from the points, credit-related data, or the like when the calling time in the VoIP phone call exceeds the predetermined period of time. In addition, the above-mentioned collection of the charge for the phone call may be limited to a phone call with a called party outside a hall, and conditions for the collection of a charge for a phone call within a hall and for the collection of a charge for a phone call with a called party outside a hall may be set to be different from each other.

As shown in the phone book screen 71 in FIG. 24B, the VoIP phone call can be made not only within a hall but also to a called party outside a hall such as a ticket office and a shop. At this time, the call control server 16 controls, via the PSTN gateway 17, the phone call with a phone connected to a PSTN 18 (refer to FIG. 22).

In addition, when a window size reduction instruction part 96 displayed at an upper right-hand side of the of the under-calling screen 91 shown in FIG. 25B is touched, a size of the under-calling screen 91 can be reduced, thereby allowing other information to be displayed.

In addition, as described above, such VoIP phone call service can be conducted also on the kiosk terminal 200. In this case, since an LCD 201 has a size larger than that of the LCD 1719 of the PTS terminal 1700, in the phone book screen 71 or the like, a larger number of call destinations can be list-displayed in the larger size. In addition, the VoIP phone call can also be made by using the above-described signage 100.

[Audio Signal Process Using Directional Microphones]

Next, an audio signal process using directional microphones will be described. In an LCD cover 1719*a* of a PTS terminal 1700 of a slot machine 1010, microphone openings 1714 and 1716 are arranged at a predetermined interval, and two microphones 1715 and 1717 are also arranged so as to be spaced apart in accordance with the interval between the microphone openings and are provided inside the LCD cover 1719*a*.

The microphone openings 1714 and 1716 are configured so as to face toward the front of a player, thereby allowing voice of a player to be effectively inputted thereto. Speaker ducts 1706 and 1708 are configured so as to have shapes which make it hard to pick up sounds, which are outputted from speakers 1707 and 1709, from the microphones 1715 and 1717. In addition, a soundproof measure which makes it hard to detect driving sound (of a fan and the like) and vibration thereinside is taken.

Figure 26:
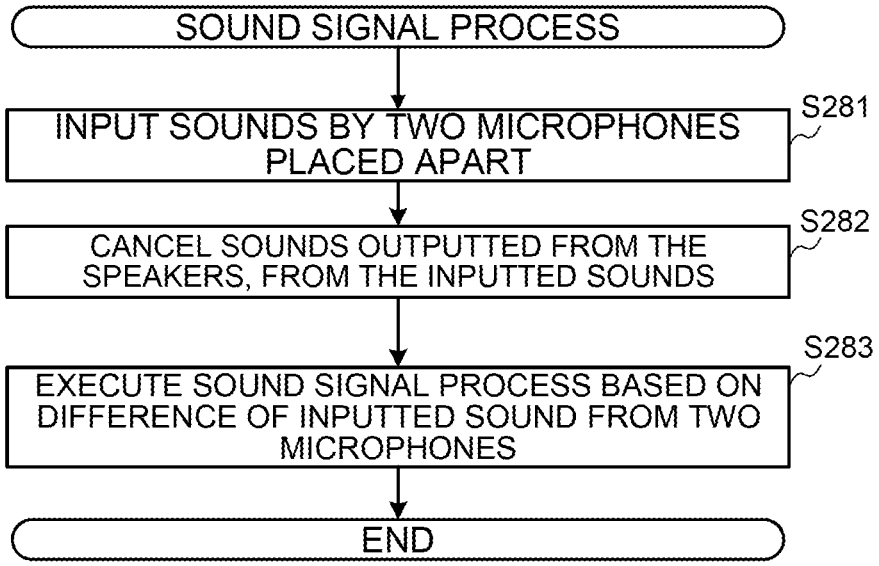
FIG. 26 is a flowchart showing a procedure of an audio signal process on the PTS terminal according to the one embodiment of the present invention.

Further, the microphones 1715 and 1717 are both directional microphones and are controlled to be operable to efficiently pick up the voice from a player. In the present embodiment, the two microphones 1715 and 1717 are, for example, unidirectional microphones having properties which allow sound from directions in a range of 180 degrees in the front in particular to be easily picked up or are super-directional microphones having properties which allow sound from directions in a range narrower than the above-mentioned range of the unidirectional microphones. Hereinafter, with reference to a flowchart shown in FIG. 26, a procedure of the audio signal process using these directional microphones will be described.

First, sounds are inputted from the two microphones 1715 and 1717 arranged at the predetermined interval as mentioned above (S281). Next, from the inputted sounds, sounds outputted from the speakers are cancelled (echo-cancelled) (S282). Since the PTS terminal 1700 of the slot machine 1010 grasps sound data outputted from its own speakers 1707 and 1709, the cancellation processing mentioned above is enabled. In addition, via a gaming machine I/F 1756 of the PTS terminal 1700, by using sound data outputted from a speaker 1112 of the slot machine 1010, the cancellation processing can be further conducted.

In addition, further, it is also made possible to conduct the cancellation processing, via a network, by using sound data outputted from speakers of other slot machines 1010 (speakers 1112 and speakers 1707 and 1709 of PTS terminals 1700).

Next, from relative positional relationship of the two microphones 1715 and 1717 and sound data obtained from the cancellation processing at S282, based on difference between the sounds inputted from the two microphones 1715 and 1717, sound data processing is executed (S283). Here, as the difference between the sounds, for example, a difference between time periods (propagation delay times), a difference between volumes, a difference between frequencies, and the like are included. In addition, in this processing, for example, a beam forming technique which controls directivity is used. For example, in a case where the two microphones 1715 and 1717 are used, considering a situation in which voice of a player comes in from a direction θ (which is an angle formed with a perpendicular line to a straight line connecting the two microphones, and angles in a predetermined range may be included), the voice of a player reaches a first microphone and thereafter, after the passage of a propagation delay time of d Sin(θ) (where d is a distance between the two microphones), reaches a second microphone. Here, an audio signal of the voice which has reached the first microphone is delayed to compensate the above-mentioned propagation delay time, and an output signal thereof is added to an audio signal of the voice which has reached (reached late) the second microphone (for example, an audio signal having the same frequency band is added), and thus, phases of the signals arriving from the direction θ match each other and the audio signals arriving from the direction θ are enhanced, and as a result, it is made possible to more efficiently collect the voice from a player. The sound data obtained by executing the above-described sound data processing is transmitted, for example, for the VoIP phone call to other PTS terminal 1700 by a CPU 1751.

With respect to the direction θ related to a position of a player, a variety of methods such as a method in which a fixed estimate value is used; a method in which the direction θ is determined from frequencies of inputted sound data; and a method in which the direction θ is determined by using a human body detection camera 1713 can be considered.

The above-described processing is conducted by a DSP 1765, and the direction θ can be adjusted at various timings and intervals.

In addition, it is also considered that the above-described processing at S283 is realized by the below-described processing. First, from relative positional relationship of the two microphones 1715 and 1717 and sound data obtained from the cancellation processing at S282, the difference between the sounds inputted from the two microphones 1715 and 1717 are analyzed. Here, as the difference between the sounds, as described above, a difference between time periods (propagation delay times), a difference between volumes, a difference between frequencies, and the like are included. In addition, in said analysis, for example, a beam forming technique which controls directivity is used. Thereafter, based on said determination result, sound data processing is executed so as to collect only sounds from a specific direction (for example, a position of a player). The sound data obtained by executing the above-described sound data processing is transmitted, for example, for the VoIP phone call to other PTS terminal 1700 by the CPU 1751.

It is to be noted that although in each of these examples, the two directional microphone are used, three or more directional microphones may be used. In addition, it is also possible to realize the above-described audio signal process by using microphones having no directivity.

REFERENCE SIGNS LIST

1 game system
200 kiosk terminal
1010 slot machine
1011 cabinet
1016 symbol display device
1030 control panel
1700 PTS terminal
1715 and 1717 microphones
1707 and 1709 speakers
1750 PTS controller
1765 DSP

The invention claimed is:

1. A gaming machine on which based on rearranged symbols, a payout is awarded, in a game system including a plurality of gaming machines, the gaming machine comprising:

a second display device for displaying a plurality of reels, each of the reels having a plurality of symbols depicted on an external surface;

a cabinet for internally housing the second display device;

a controller of the gaming machine for rotating and stopping the plurality of reels and controlling the symbols depicted on the plurality of reels to be rearranged; and an information terminal being incorporated into the cabinet, wherein the information terminal comprises:

a display device for displaying information; and an input device for inputting an instruction of a user, a controller of the information terminal executing processes described below:

a process (A) in which by reading an IC device of the user being a member, information pertinent to other member being previously registered as a call destination of the user is displayed on the display device; and a process (B) in which in accordance with the instruction inputted by the input device of the user, a VoIP phone call is made to the other member being selected as the call destination, wherein the other member is registered as the call destination when, in a case where an information terminal of a certain gaming machine of the plurality of gaming machines is reading the IC device of the user, the information terminal of the certain gaming machine reading the IC device of the user reads user information recording medium of the other member.

2. The gaming machine according to claim 1, wherein the information terminal of the certain gaming machine is same as the information terminal being incorporated into the cabinet.

3. The gaming machine according to claim 1, wherein the information terminal of the certain gaming machine includes a card insertion slot for holding and reading the IC device, and a touch unit on which the user information recording medium is touched.

4. The gaming machine according to claim 3, wherein the information terminal of the certain gaming machine is same as the information terminal being incorporated into the cabinet.

* * * * *